US010369075B2

(12) United States Patent
Mayer et al.

(10) Patent No.: US 10,369,075 B2
(45) Date of Patent: Aug. 6, 2019

(54) INSOLE FOOT COMPRESSION SYSTEM AND METHODS

(71) Applicant: Avex, LLC, Grand Junction, CO (US)

(72) Inventors: Matthew J. Mayer, Grand Junction, CO (US); Gerhard B. Rill, Clifton, CO (US); Mark Joseph, Aspen, CO (US); Neal Beidleman, Aspen, CO (US)

(73) Assignee: AVEX, LLC, Grand Junction, CO (US)

( * ) Notice: Subject to any disclaimer, the term of this patent is extended or adjusted under 35 U.S.C. 154(b) by 808 days.

(21) Appl. No.: 14/637,143

(22) Filed: Mar. 3, 2015

(65) Prior Publication Data

US 2016/0256349 A1 Sep. 8, 2016

(51) Int. Cl.
*A61H 23/02* (2006.01)
*A43B 7/14* (2006.01)
(Continued)

(52) U.S. Cl.
CPC ..... *A61H 23/02* (2013.01); *A43B 3/0005* (2013.01); *A43B 7/14* (2013.01); *A43B 7/142* (2013.01); *A43B 7/1465* (2013.01); *A43B 17/04* (2013.01); *A43B 17/14* (2013.01); *A61H 7/001* (2013.01); *A61H 2201/1215* (2013.01); *A61H 2201/149* (2013.01); *A61H 2201/164* (2013.01); *A61H 2201/1664* (2013.01); *A61H 2201/5005* (2013.01); *A61H 2201/5061* (2013.01);
(Continued)

(58) Field of Classification Search
CPC ..... A61H 23/02; A61H 7/001; A61H 2201/5061; A61H 2201/1215; A61H 2201/5005; A61H 2201/1664; A61H 2201/164; A61H 2201/149; A61H 2209/00; A61H 2205/12; A43B 14/04; A43B 7/1465; A43B 7/142; A43B 3/005; A43B 7/14; A43B 17/14
See application file for complete search history.

(56) References Cited

U.S. PATENT DOCUMENTS 1,546,506 A * 7/1925 Naysmith ..... A61H 1/0266 482/79
2,397,428 A 3/1946 Moshier
(Continued)

FOREIGN PATENT DOCUMENTS

AT 506689 11/2009
CA 2730238 5/2017
(Continued)

OTHER PUBLICATIONS

Examination Report dated Sep. 8, 2015 for European Patent Application No. 09795105.7.
(Continued)

*Primary Examiner* — Steven O Douglas
(74) *Attorney, Agent, or Firm* — Snell & Wilmer L.L.P.

(57) ABSTRACT

Insole compression systems apply intermittent pressure to a foot or other body part, for example in order to increase circulation and facilitate removal of metabolic waste. The insole compression systems, including actuators and batteries, may be fully contained within a removable insole, and are thus discreet and easy to use. In exemplary insole compression systems, extension springs and a torsion spring interact with an a-frame to deliver an approximately constant extension force.

8 Claims, 17 Drawing Sheets

(51) Int. Cl.

| | |
|---|---|
| ***A43B 17/14*** | (2006.01) |
| ***A43B 3/00*** | (2006.01) |
| ***A43B 17/04*** | (2006.01) |
| ***A61H 7/00*** | (2006.01) |

(52) U.S. Cl.
CPC .. *A61H 2201/5084* (2013.01); *A61H 2205/12* (2013.01); *A61H 2209/00* (2013.01)

(56) References Cited

U.S. PATENT DOCUMENTS

| | | | | |
|---|---|---|---|---|
| 2,836,174 | A | 5/1958 | Infanger | |
| 3,512,522 | A | 5/1970 | Greenlee et al. | |
| 3,612,043 | A | 10/1971 | Inaki | |
| 3,888,242 | A | 6/1975 | Harris et al. | |
| 3,917,261 | A | 11/1975 | Small et al. | |
| 4,088,128 | A | 5/1978 | Mabuchi | |
| 4,166,329 | A | 9/1979 | Herbig | |
| 4,294,236 | A | 10/1981 | Hofstein | |
| 4,299,206 | A | 11/1981 | Hofstein | |
| 4,721,101 | A | 1/1988 | Gardner et al. | |
| 4,856,496 | A | 8/1989 | Chursinoff | |
| 5,176,624 | A | 1/1993 | Huehnreich | |
| 5,357,696 | A | 10/1994 | Gray et al. | |
| 5,407,418 | A * | 4/1995 | Szpur | A61H 7/001 601/101 |
| 5,443,440 | A | 8/1995 | Tumey et al. | |
| 5,584,798 | A | 12/1996 | Fox | |
| 5,605,533 | A | 2/1997 | Badilla | |
| 5,656,017 | A | 8/1997 | Keller et al. | |
| 5,674,262 | A | 10/1997 | Tumey et al. | |
| 5,682,690 | A | 11/1997 | Chang | |
| 5,688,225 | A | 11/1997 | Walker | |
| 5,931,797 | A | 8/1999 | Tumey et al. | |
| 6,135,116 | A | 10/2000 | Vogel et al. | |
| 6,205,618 | B1 | 3/2001 | Lee | |
| 6,234,987 | B1 | 5/2001 | Chen | |
| 6,319,215 | B1 | 11/2001 | Manor et al. | |
| 6,360,457 | B1 | 3/2002 | Qui et al. | |
| 6,585,669 | B2 | 7/2003 | Manor et al. | |
| 6,615,080 | B1 | 9/2003 | Unsworth et al. | |
| 6,685,661 | B2 | 2/2004 | Peled | |
| 6,702,768 | B2 | 3/2004 | Mano et al. | |
| 6,893,409 | B1 | 5/2005 | Lina | |
| 7,107,706 | B1 | 9/2006 | Bailey, Sr. et al. | |
| 7,188,439 | B2 | 3/2007 | DiBenedetto et al. | |
| 7,219,449 | B1 | 5/2007 | Hoffberg et al. | |
| 7,282,038 | B2 | 10/2007 | Gillis et al. | |
| 7,310,895 | B2 | 12/2007 | Whittlesey et al. | |
| 7,318,291 | B2 | 1/2008 | Wang et al. | |
| 7,395,614 | B1 | 7/2008 | Bailey, Sr. et al. | |
| 7,506,460 | B2 | 3/2009 | DiBenedetto et al. | |
| 7,544,173 | B2 | 6/2009 | Suzuki | |
| 7,596,891 | B2 | 10/2009 | Carnes et al. | |
| 7,607,243 | B2 | 10/2009 | Berner, Jr. et al. | |
| 7,618,382 | B2 | 11/2009 | Vogel et al. | |
| 7,631,382 | B2 | 12/2009 | DiBenedetto et al. | |
| 7,640,681 | B2 | 1/2010 | Yang et al. | |
| 7,676,960 | B2 | 3/2010 | DiBenedetto et al. | |
| 7,909,783 | B2 | 3/2011 | Mayer et al. | |
| 7,980,009 | B2 | 7/2011 | Carnes et al. | |
| 8,056,268 | B2 | 11/2011 | DiBenedetto et al. | |
| 8,246,556 | B2 * | 8/2012 | Mayer | A61H 23/02 601/104 |
| 8,308,665 | B2 | 11/2012 | Harry et al. | |
| 9,283,139 | B2 | 3/2016 | Mayer et al. | |
| 9,439,828 | B2 | 9/2016 | Mayer et al. | |
| 9,757,302 | B2 | 9/2017 | Mayer | |
| 2002/0068884 | A1 | 6/2002 | Alviso | |
| 2002/0133106 | A1 | 9/2002 | Peled | |
| 2003/0139255 | A1 | 7/2003 | Lina | |
| 2004/0030270 | A1 | 2/2004 | Johnson | |
| 2004/0059386 | A1 | 3/2004 | Yu | |
| 2004/0064974 | A1 | 4/2004 | Schuster | |
| 2005/0039348 | A1 * | 2/2005 | Raluy | A43B 3/12 36/50.1 |
| 2005/0126049 | A1 | 6/2005 | Koenig | |
| 2005/0187496 | A1 | 8/2005 | Ho | |
| 2005/0187601 | A1 | 8/2005 | Wang | |
| 2006/0213091 | A1 | 9/2006 | Ometto et al. | |
| 2008/0010851 | A1 | 1/2008 | Avanzini | |
| 2008/0066343 | A1 | 3/2008 | Sanabria-Hernandez | |
| 2008/0071202 | A1 | 3/2008 | Nardi et al. | |
| 2008/0072451 | A1 | 3/2008 | Mizrahi | |
| 2008/0097268 | A1 | 4/2008 | Rousso | |
| 2008/0161734 | A1 | 7/2008 | Blockton | |
| 2008/0263899 | A1 * | 10/2008 | Lee | A43B 1/0045 36/102 |
| 2009/0030354 | A1 | 1/2009 | Ghatge | |
| 2009/0069865 | A1 | 3/2009 | Lasko et al. | |
| 2009/0149899 | A1 | 6/2009 | Ahn | |
| 2010/0094184 | A1 | 4/2010 | Wong et al. | |
| 2010/0198118 | A1 | 8/2010 | Itnati | |
| 2010/0257752 | A1 * | 10/2010 | Goldston | A43B 3/0031 36/108 |
| 2011/0010398 | A1 | 1/2011 | Gruenwald | |
| 2011/0089725 | A1 | 4/2011 | Shantha et al. | |
| 2011/0166480 | A1 | 7/2011 | Mayer | |
| 2012/0046694 | A1 | 2/2012 | Miller | |
| 2013/0041298 | A1 | 2/2013 | Mayer et al. | |

FOREIGN PATENT DOCUMENTS

| | | |
|---|---|---|
| CN | 2476275 | 2/2002 |
| CN | 1486148 | 3/2004 |
| CN | 2902266 | 5/2007 |
| EP | 1509101 | 3/2005 |
| JP | 2002325819 | 11/2002 |
| JP | 2004-526477 | 9/2004 |
| JP | 2006521879 | 9/2006 |
| JP | 2008114048 | 5/2008 |
| KR | 20-0265394 | 2/2002 |
| KR | 20030059973 | 7/2003 |
| KR | 20070049008 | 5/2007 |
| KR | 20080070175 | 7/2008 |
| WO | 95-10257 | 4/1995 |
| WO | 2005013743 | 2/2005 |
| WO | 2009152544 | 12/2009 |
| WO | WO 2011109725 | 9/2011 |

OTHER PUBLICATIONS

Non-Final Office Action dated Sep. 10, 2015 for U.S. Appl. No. 13/554,834.
Office Action dated Aug. 25, 2015 for Chinese Patent Application No. 201280068673.X.
Restriction Requirement dated Oct. 7, 2015 for U.S. Appl. No. 14/178,554.
Office Action dated Aug. 28, 2015 for Canadian Patent Application No. 2730238.
Examination Report dated Nov. 6, 2015 for Australian Patent Application No. 2009268641.
Office Action dated Jan. 8, 2016 for Korean Patent Application No. 2001-7001073.
Notice of Allowance dated Dec. 7, 2015 for U.S. Appl. No. 13/193,446.
Non-Final Office Action dated Dec. 22, 2015 for U.S. Appl. No. 14/178,554.
Final Office Action dated Jan. 13, 2016 for U.S. Appl. No. 13/554,834.
Office Action dated Mar. 10, 2016 for Chinese Patent Application No. 201510026309.2.
Office Action dated Mar. 24, 2016 for Korean Patent Application No. 2011-7001073.
Office Action dated Mar. 29, 2016 for Chinese Patent Application No. 201280068673.X.
Notice of Allowance and Examiner's Interview Summary dated May 3, 2016 for U.S. Appl. No. 13/554,834.
Office Action dated Jun. 10, 2015 for Canadian Patent Application No. 2,730,238.

(56) References Cited

OTHER PUBLICATIONS

Office Action dated Jun. 27, 2016 for Chinese Patent Application No. 201280068673.X.
Non-Final Office Action dated Jul. 14, 2016 for U.S. Appl. No. 14/178,554.
International Search Report and Written Opinion dated Jul. 29, 2016 for PCT/US2016/019236.
Office Action dated Nov. 1, 2016 for Chinese Patent Application No. 20150026309.2.
Final Office Action dated Jan. 23, 2017 for U.S. Appl. No. 14/178,554.
Notice of Allowance dated Jan. 2, 2017 for Canadian Patent Application No. 2,730,238.
Interview Summary dated Apr. 7, 2017 for U.S. Appl. No. 14/178,554.
Non-Final Office Action dated Apr. 19, 2017 for U.S. Appl. No. 14/362,108.
Office Action dated Apr. 25, 2017 for Chinese Patent Application No. 201510026309.2.
Notice of Allowance and Examiner's Amendment dated May 24, 2017 for U.S. Appl. No. 14/178,554.
Examination Report dated Aug. 19, 2015 for Australian Patent Application No. 2009268641.
European Search Report and Opinion dated Jun. 15, 2015 for European Patent Application No. 12853699.2.
Advisory Action dated Aug. 10, 2015 for U.S. Appl. No. 13/193,446.
Notice of Allowance dated Apr. 12, 2012 for U.S. Appl. No. 13/004,754.
Non-Final Office Action dated Aug. 1, 2014 for U.S. Appl. No. 13/193,446.
Office Action dated Sep. 8, 2012 for Mexican Patent Application No. MX/a/2011/000246.
International Preliminary Report on Patentability dated Jun. 12, 2014 for PCT/US2012/067365.
Office Action dated Jul. 24, 2014 for Chinese Patent Application No. 200980132527.7.
Examination Report dated Aug. 5, 2014 for European Patent Application No. 09795105.7.
Office Action dated May 2, 2012 for Mexican Patent Application No. MX/a/2011/000246.
Final Office Action dated Mar. 12, 2014 for U.S. Appl. No. 13/040,982.
Examination Report dated Feb. 9, 2015 for European Patent Application No. 09795105.7.
Examiner's Interview dated Mar. 20, 2012 for U.S. Appl. No. 13/004,754.
Examination Report dated May 13, 2014 for Australian Patent Application No. 2009268641.
Examination Report dated Mar. 26, 2015 for Australian Patent Application No. 200926641.
Final Office Action dated Mar. 26, 2015 for U.S. Appl. No. 13/193,446.
Notice of Allowance dated Aug. 28, 2013 for Mexican Patent Application No. MX/a/2011/000246.
European Search Report and Opinion dated May 3, 2012 for European Application No. 09795105.7.
Office Action dated Jun. 9, 2013 for Chinese Patent Application No. 200980132527.7.
Office Action dated Mar. 6, 2014 for Chinese Patent Application No. 200980132527.7.
International Preliminary Report on Patentability dated Feb. 27, 2014 for PCT/US2012/050290.
Office Action dated Aug. 3, 2012 for Mexican Patent Application No. MX/a/2011/000246.
International Preliminary Report on Patentability dated Sep. 20, 2012 for PCT/US2011/027220.
International Search Report and Written Opinion dated Oct. 26, 2012 for PCT/US2012/050290.
International Search Report and Written Opinion dated Feb. 15, 2013 for PCT/US2012/067365.
Office Action dated Feb. 12, 2013 for Mexican Patent Application No. MX/a/2011/000246.
Examination Report dated Mar. 5, 2013 for European Patent Application No. 09795105.7.
Non-Final Office Action dated May 15, 2013 for U.S. Appl. No. 13/040,982.
International Search Report and Written Opinion dated Nov. 15, 2011 for PCT/US2009/049910.
International Search Report and Written Opinion dated Nov. 22, 2011 for PCT/US2011/027220.
Non-Final Office Action dated Sep. 21, 2011 for U.S. Appl. No. 13/004,754.
Non-Final Office Action dated Feb. 7, 2012 for U.S. Appl. No. 13/004,754.
Notice of Allowance, Examiner's Interview and Examiner's Amendment dated Dec. 29, 2010 for U.S. Appl. No. 12/499,473.
Notice of Allowance, Examiner's Interview and Examiner's Amendment dated Nov. 29, 2010 for U.S. Appl. No. 12/499,473.
Final Office Action dated Jun. 22, 2010 for U.S. Appl. No. 12/499,473.
Non-Final Office Action dated Apr. 15, 2010 for U.S. Appl. No. 12/499,473.
International Preliminary Report on Patentability dated Sep. 14, 2017 from PCT Application No. PCT/US2016/019236.

* cited by examiner

INSOLE FOOT COMPRESSION SYSTEM AND METHODS

TECHNICAL FIELD

The present disclosure generally relates to systems and methods for increasing blood flow to a part of the body, such as the legs and feet. Accordingly, the present disclosure generally relates to systems and methods for mechanically compressing an area of the body, such as the venous plexus region in the arch of the foot, and the superficial veins of the top of the foot to stimulate blood flow.

BACKGROUND

Under normal circumstances, blood moves up the legs due to muscle contraction and general movement of the feet or legs, such as when walking. If a person is immobilized, unable to move regularly, or has poor circulation brought on by disease, the natural blood return mechanism is impaired, and circulatory problems such as ulcers, deep vein thrombosis, and pulmonary embolisms can occur.

To mitigate the problems caused by low mobility and poor circulation, it is desirable to enhance circulation through alternative means, for example means mimicking the effects of walking or otherwise increasing circulation.

SUMMARY

An insole compression system is configured to apply pressure to a foot, for example in order to increase circulation. In an exemplary embodiment, a foot compression system comprises a pressure pad pivotably coupled to an a-frame about an axle, an extension spring coupled to the a-frame, and a torsion spring disposed about the axle. The foot compression system is completely containable within an orthotic insole.

In another exemplary embodiment, an insole compression system comprises an insole configured for insertion into an item of footwear, and an actuator. The actuator comprises a pressure pad pivotably coupled to an a-frame about an axle, a first extension spring and a second extension spring coupled to the a-frame, and a torsion spring disposed about the axle.

In another exemplary embodiment, a method of implementing athletic recovery in a person following exercise comprises moving, via an actuator, a pressure pad a first time to bring the pressure pad into contact with a foot to compress a portion of the foot. The pressure pad, the actuator, and a power source for the actuator are completely contained within an insole. The insole is insertable and removable from a shoe. The method further comprises moving, via the actuator, the pressure pad a second time to bring the pressure pad out of contact with the foot to allow the portion of the foot to at least partially refill with blood, and moving, via the actuator, the pressure pad a third time to bring the pressure pad into contact with the foot to force at least a portion of the blood out of the portion of the foot.

In yet another exemplary embodiment, a method of treating a medical condition selected from a group comprising edema, restless leg syndrome, venous insufficiency, plantar fasciitis, or a wound comprises moving, by an insole compression system having an actuator and power source therefor completely contained in an orthotic insole, a pressure pad a first time to bring the pressure pad into contact with a portion of a human body to compress the portion of the human body, moving, by the insole compression system, the pressure pad a second time to bring the pressure pad out of contact with the portion of a human body to allow the portion of the human body to at least partially refill with blood, and moving, by the insole compression system, the pressure pad a third time to bring the pressure pad into contact with the portion of the human body to compress the portion of the human body.

The contents of this summary section are provided only as a simplified introduction to the disclosure, and are not intended to be used to limit the scope of the appended claims.

BRIEF DESCRIPTION OF THE DRAWINGS

The subject matter of the present disclosure is particularly pointed out and distinctly claimed in the concluding portion of the specification. The present disclosure, however, both as to organization and method of operation, may best be understood by reference to the following description taken in conjunction with the claims and the accompanying drawing figures, in which like parts may be referred to by like numerals:

DETAILED DESCRIPTION

Figure 1A:
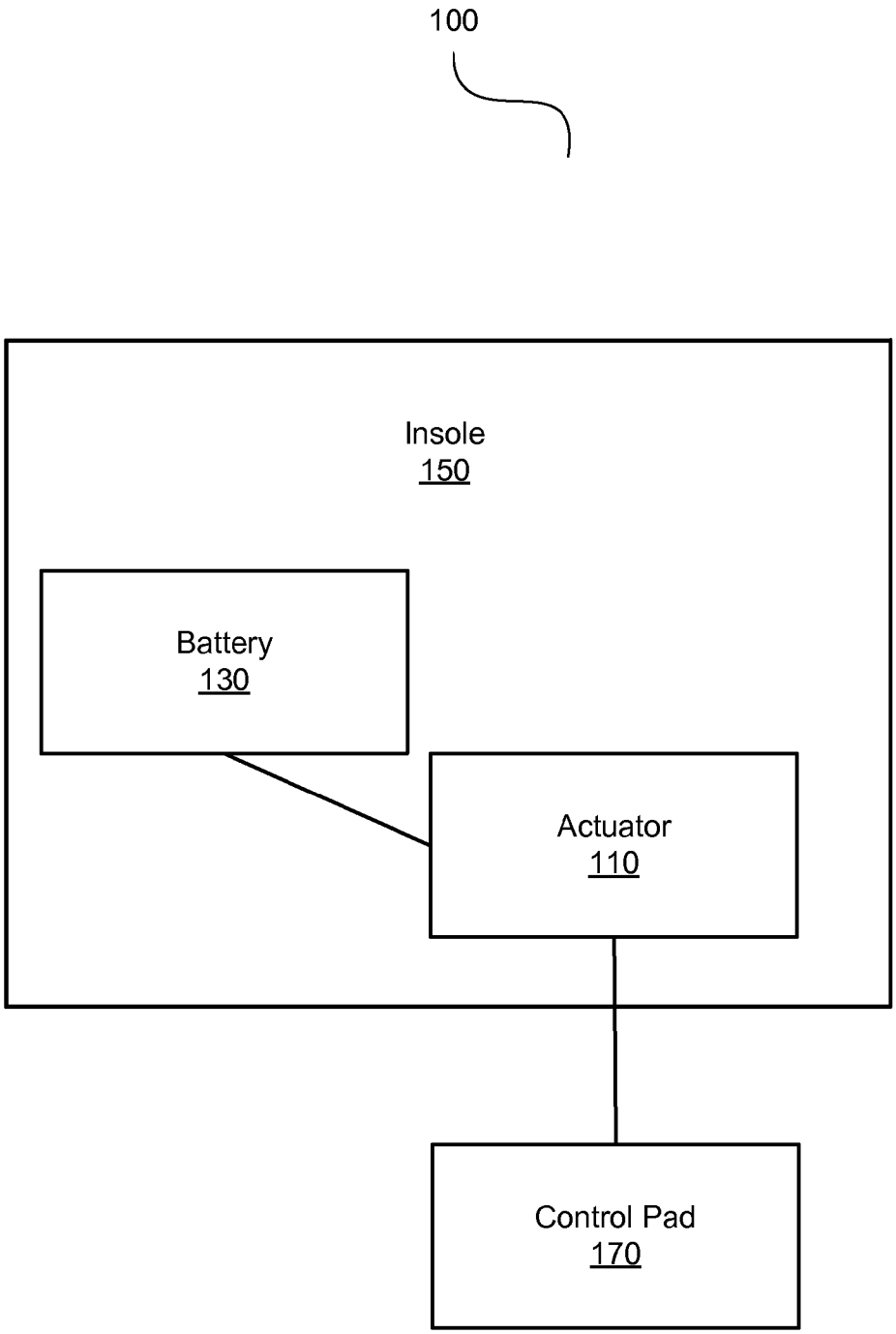
FIG. 1A illustrates a block diagram of an insole compression system in accordance with an exemplary embodiment.
Figure 1B:
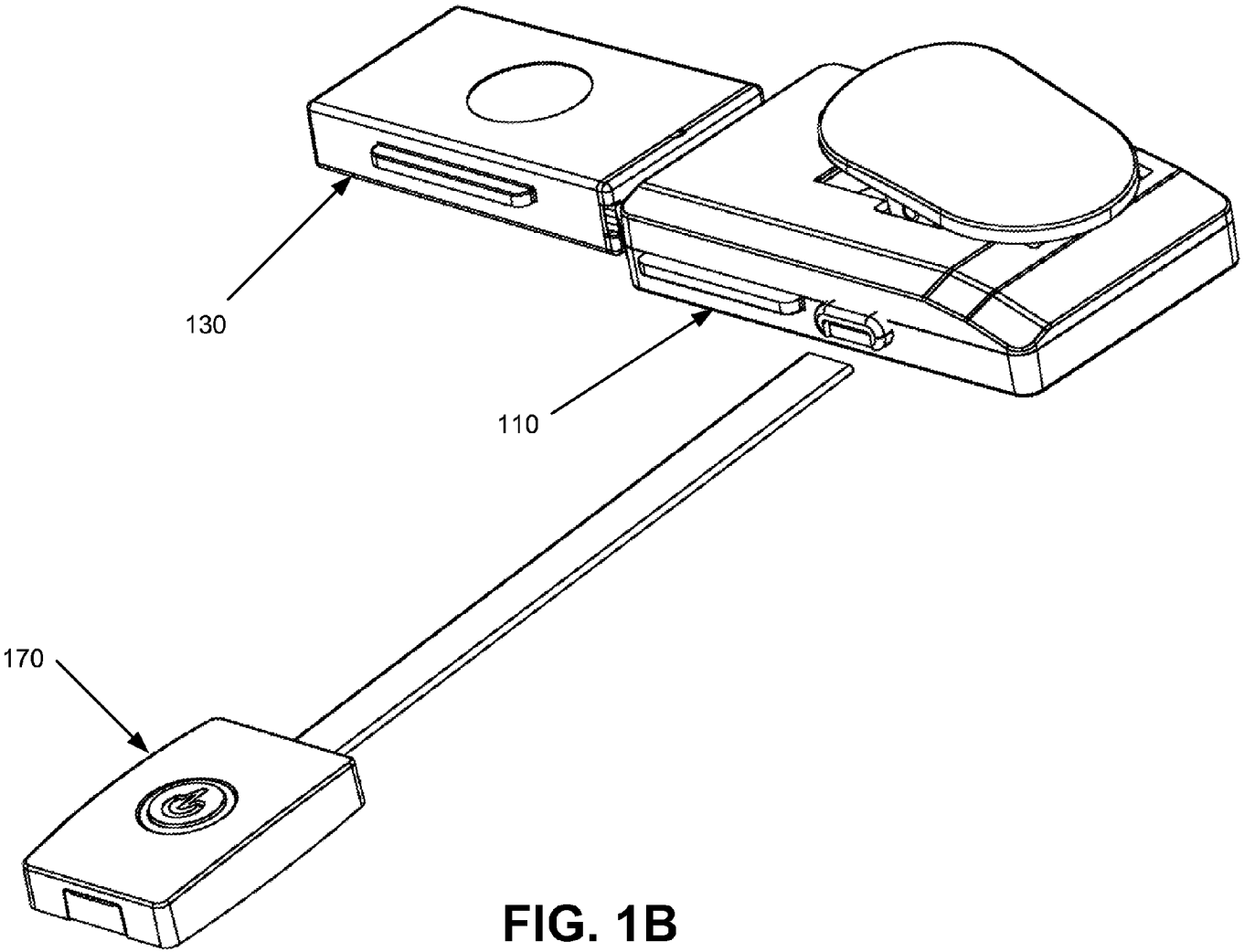
FIG. 1B illustrates components of an insole compression system in accordance with an exemplary embodiment.
Figure 1C:
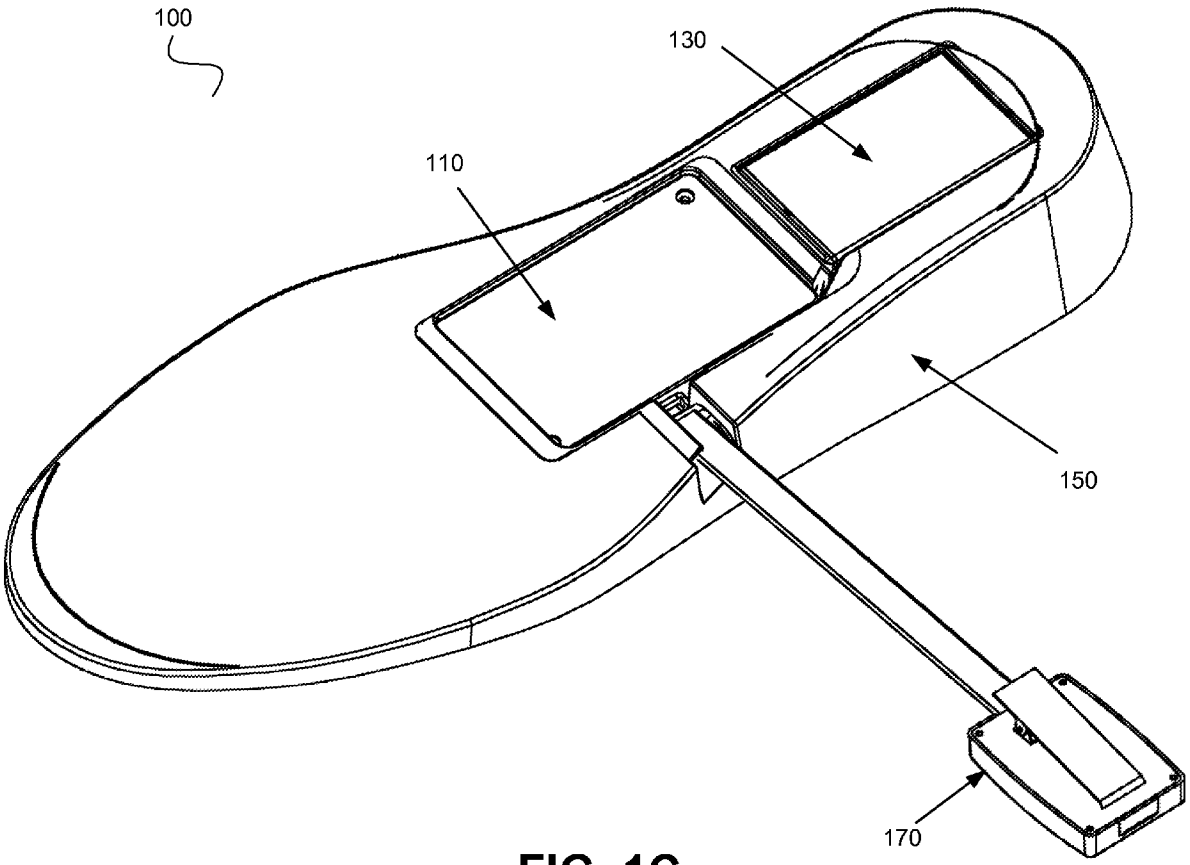
FIG. 1C illustrates components of an insole compression system in accordance with an exemplary embodiment.
Figure 1D:
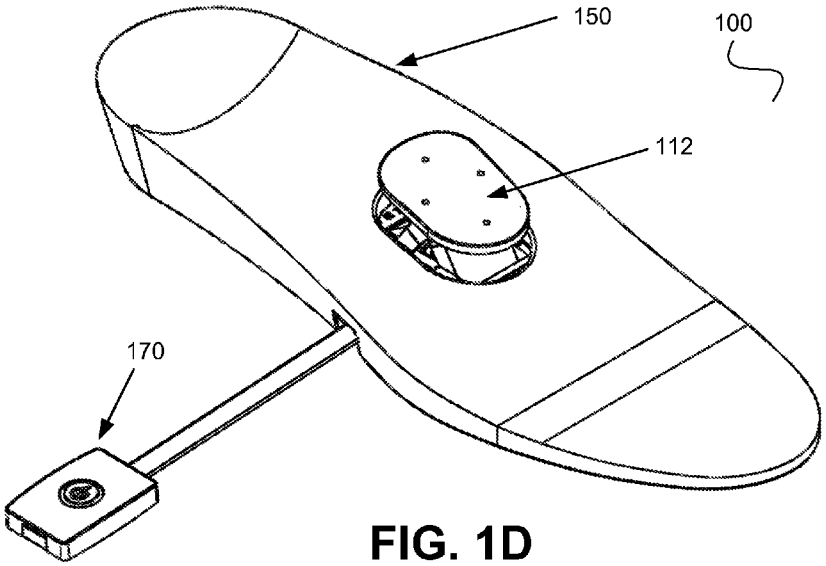
FIG. 1D illustrates an insole compression system with a pressure pad extended in accordance with an exemplary embodiment.
Figure 1E:
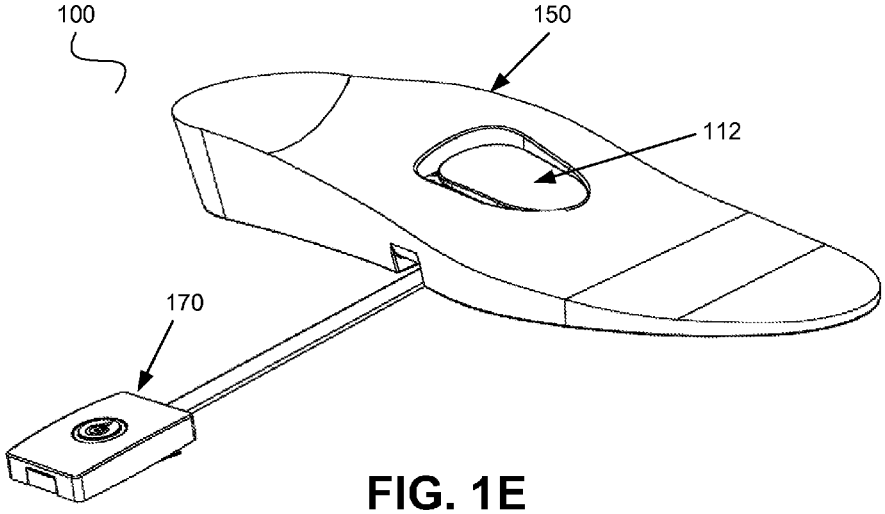
FIG. 1E illustrates an insole compression system with a pressure pad retracted in accordance with an exemplary embodiment.
Figure 1F:
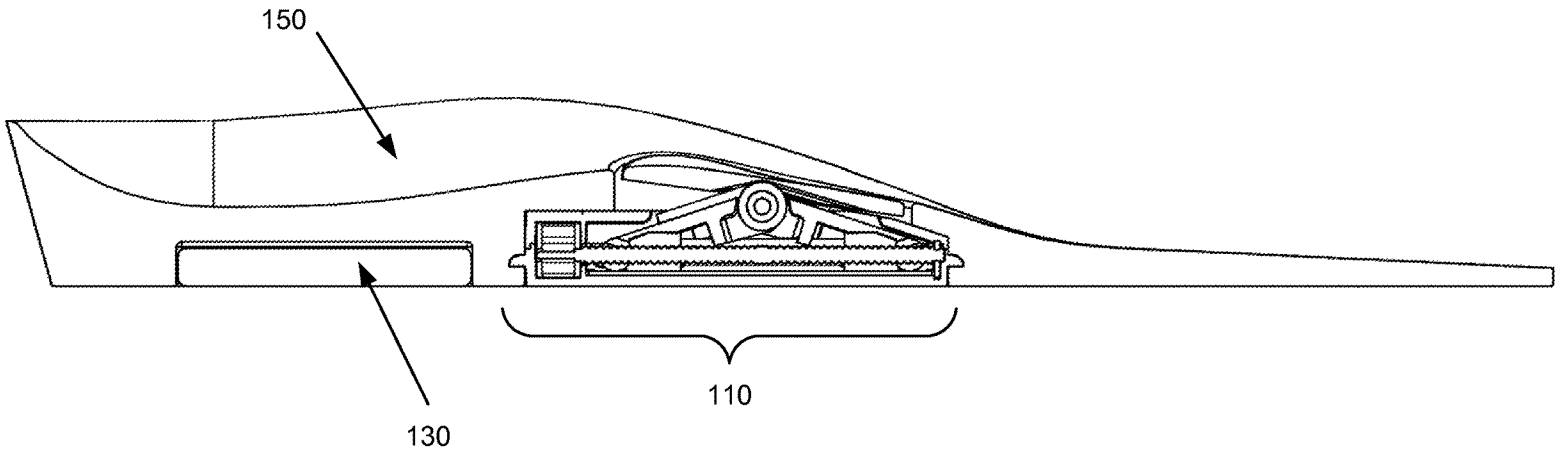
FIG. 1F illustrates a cut-away view of components of an insole compression system with a pressure pad retracted in accordance with an exemplary embodiment.
Figure 1G:
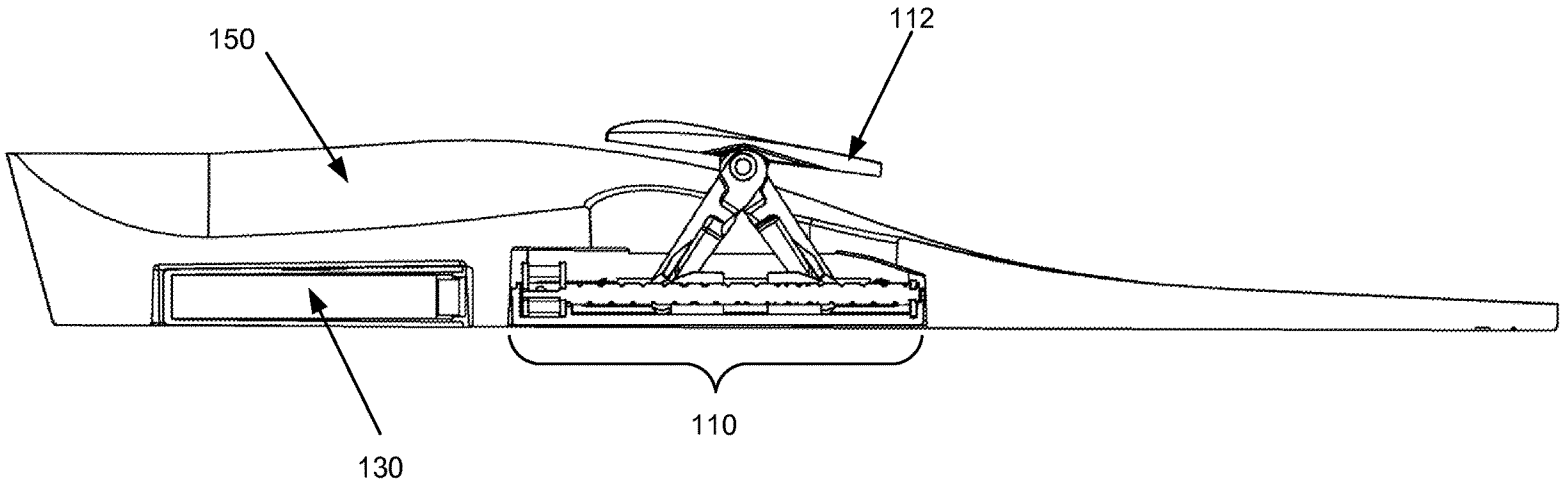
FIG. 1G illustrates a cut-away view of components of an insole compression system with a pressure pad extended in accordance with an exemplary embodiment.
Figure 2A:
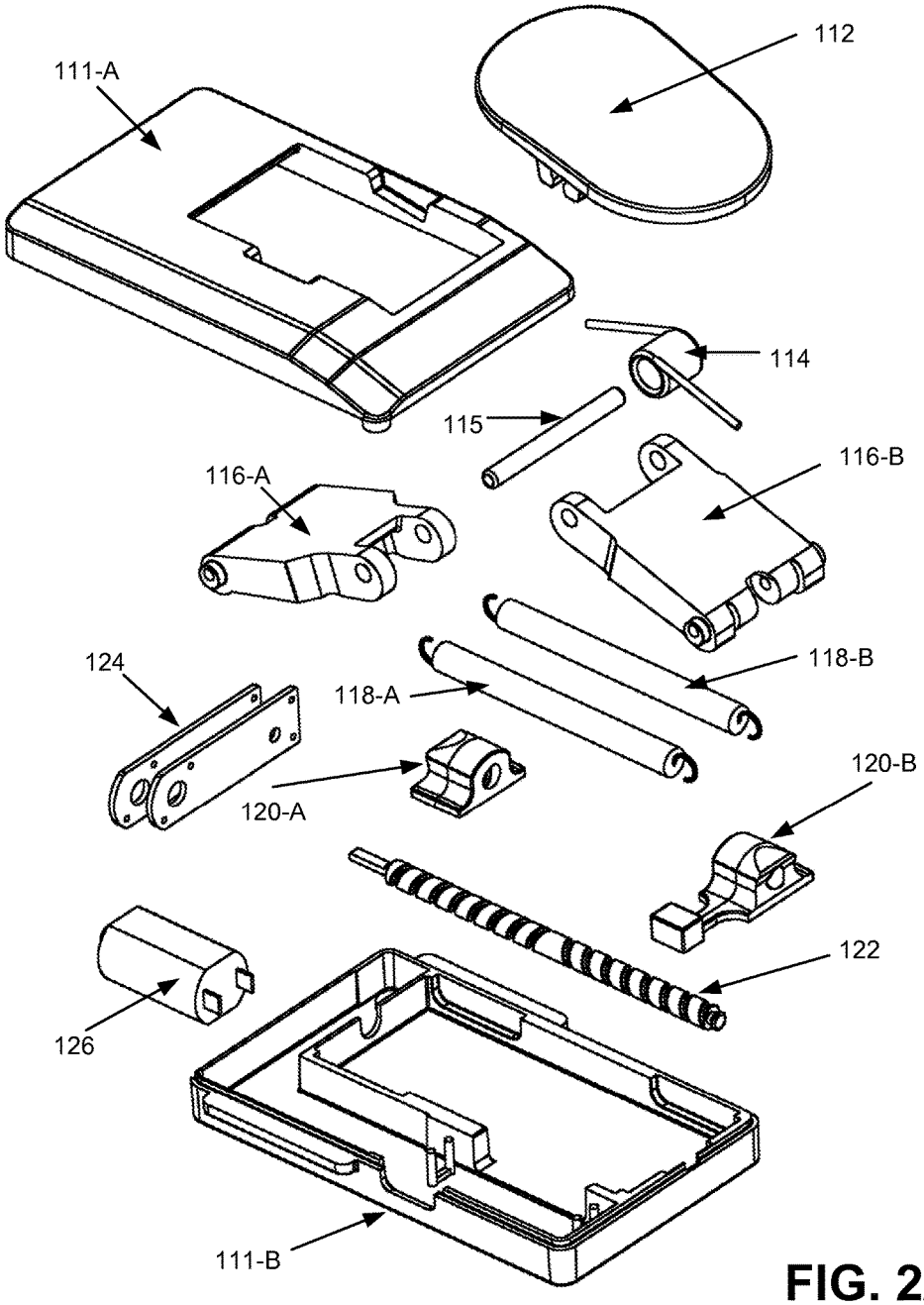
FIG. 2A illustrates components of an actuator of an insole compression system in accordance with an exemplary embodiment.
Figure 2B:
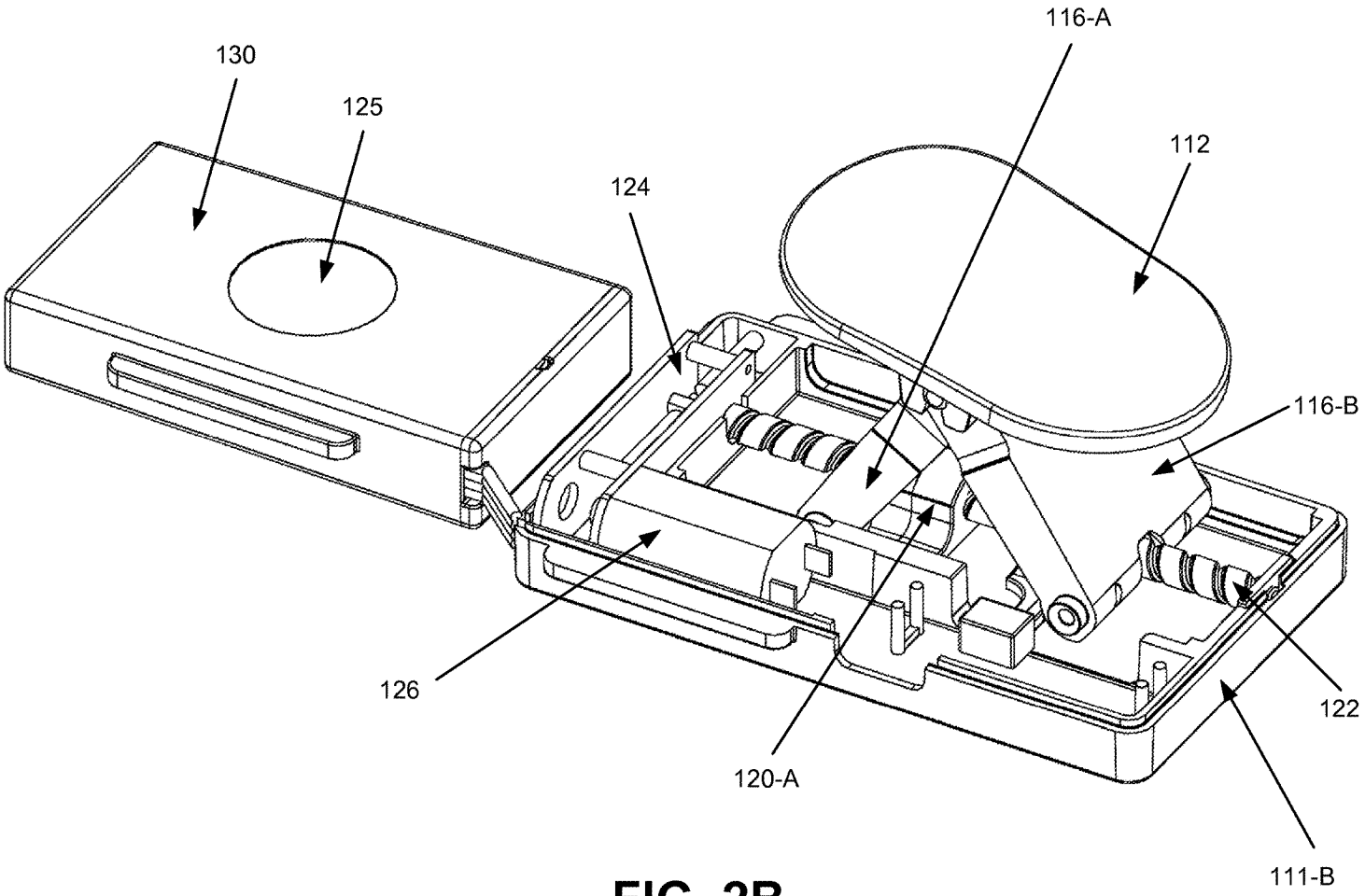
FIG. 2B illustrates components of an actuator of an insole compression system, showing a pressure pad extended, in accordance with an exemplary embodiment.
Figure 2C:
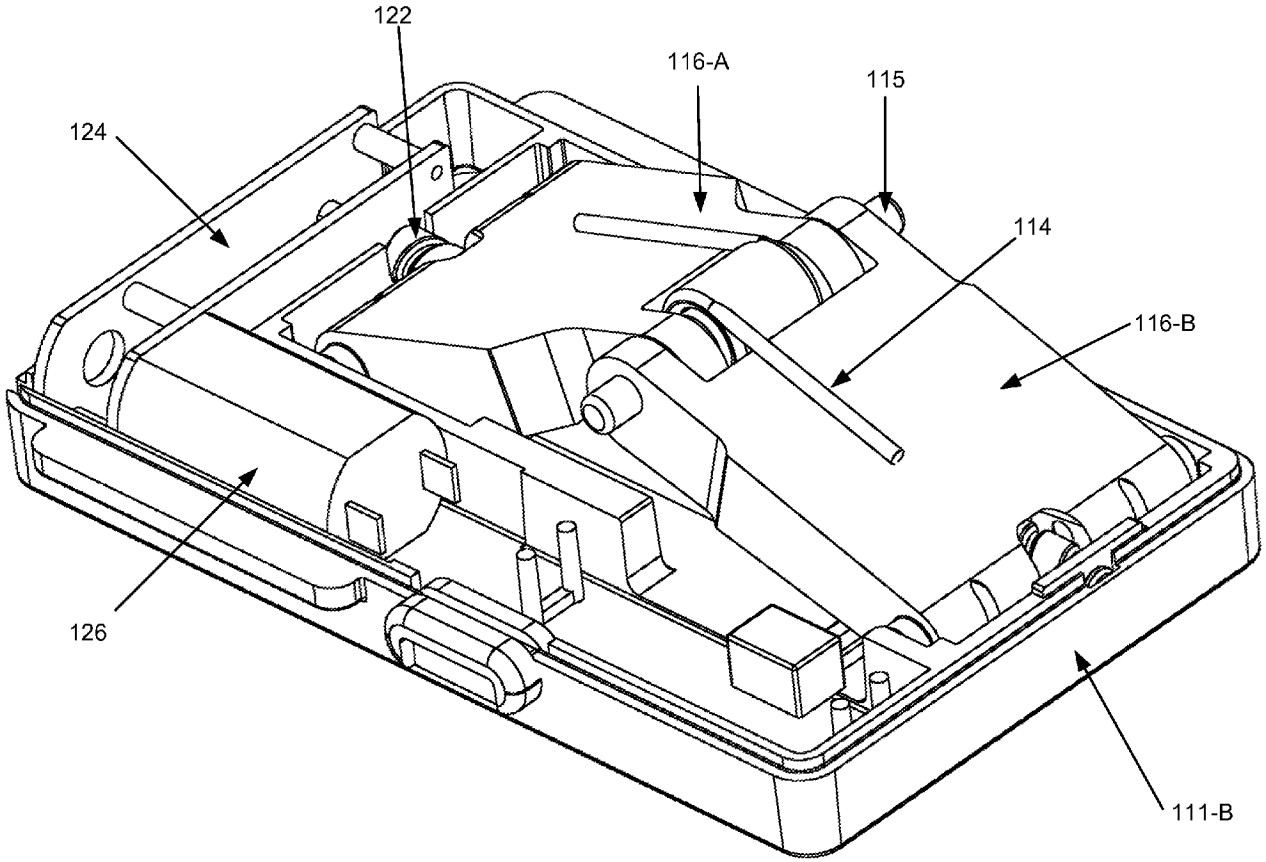
FIG. 2C illustrates components of an actuator of an insole compression system, showing an a-frame open, in accordance with an exemplary embodiment.
Figure 2D:
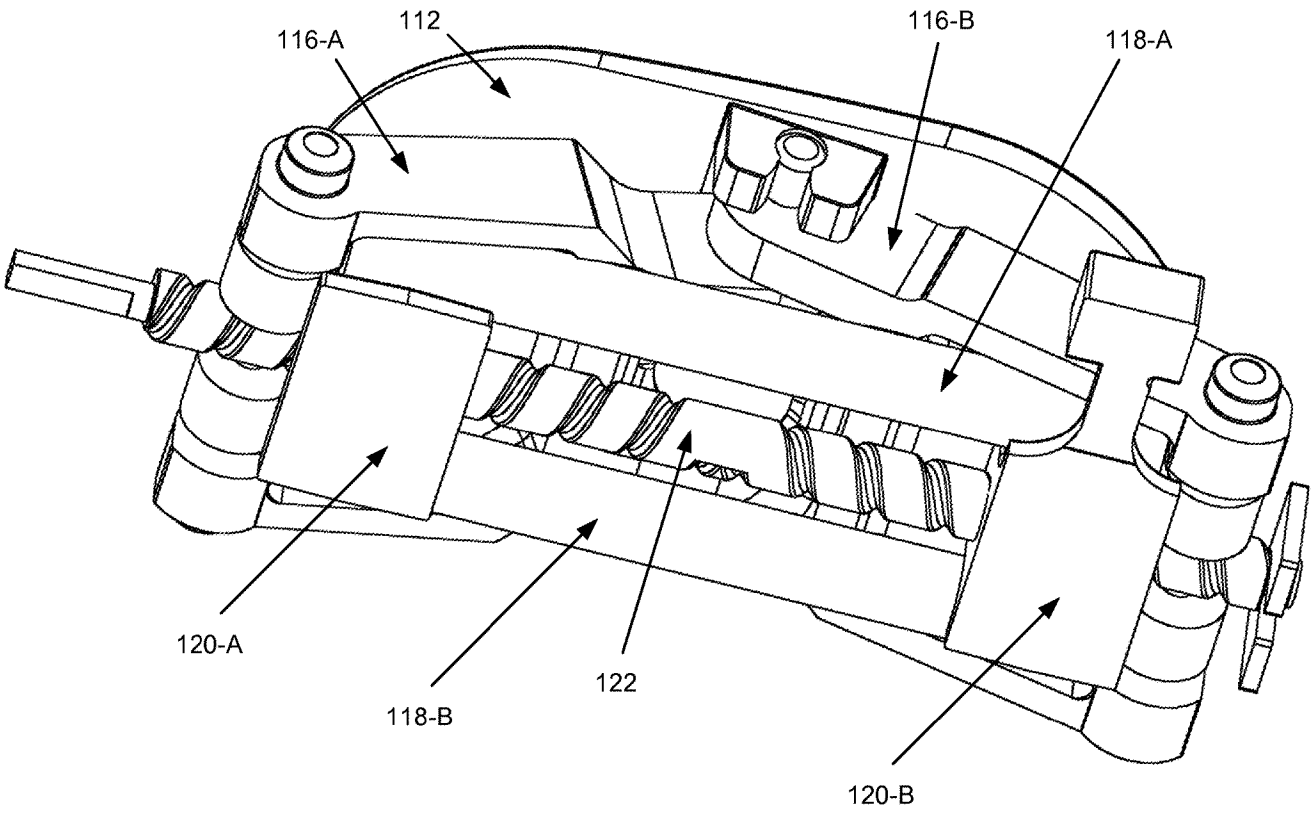
FIGS. 2D and 2E illustrate components of an actuator of an insole compression system in accordance with an exemplary embodiment.
Figure 2E:
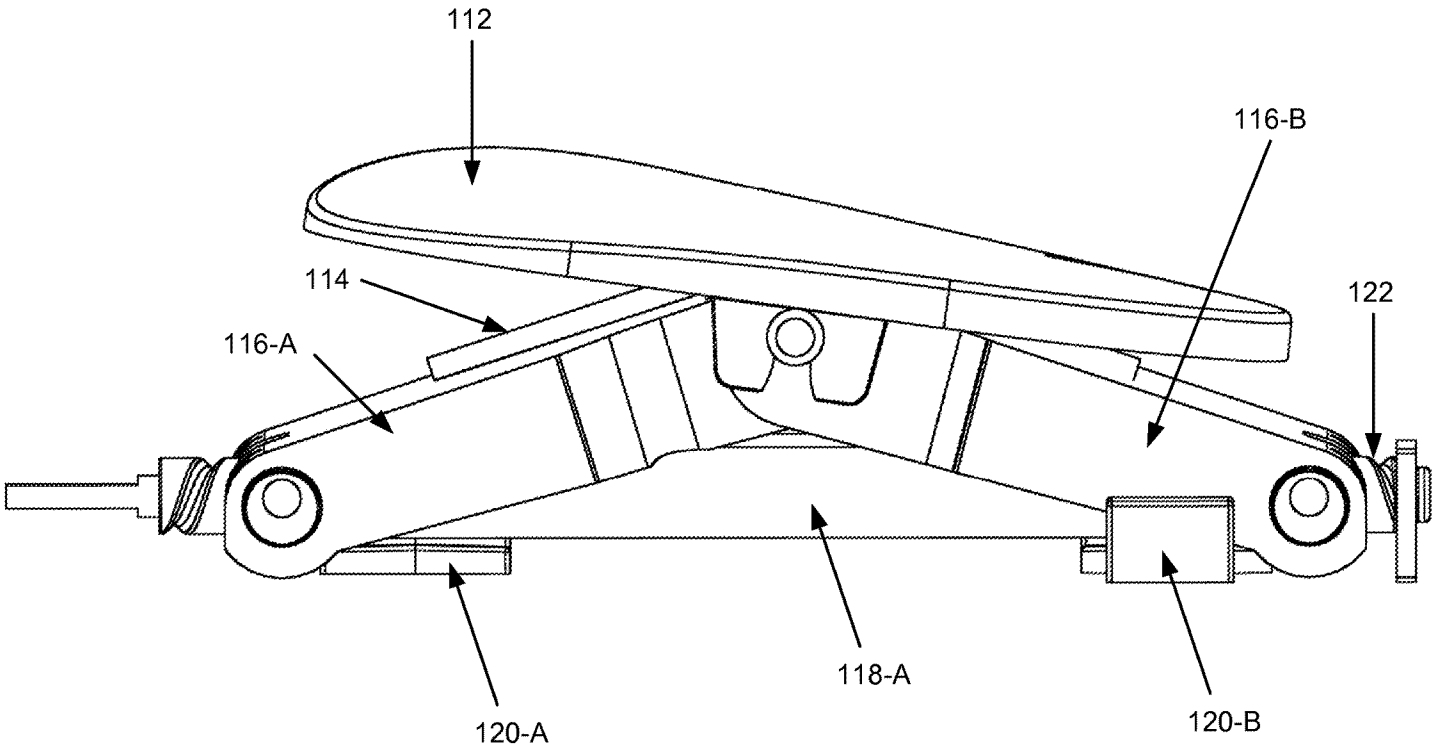

Details of the present disclosure may be described herein in terms of various components and processing steps. It should be appreciated that such components and steps may be realized by any number of hardware and/or software components configured to perform the specified functions. For example, the system may employ various medical treatment devices, input and/or output elements and the like, which may carry out a variety of functions under the control of one or more control systems or other control devices. In addition, details of the present disclosure may be practiced in any number of medical or treatment contexts, and exemplary embodiments relating to an insole compression system, for example usable in connection with treatment of deep vein thrombosis, or in connection with athletic recovery, as described herein are merely a few of the exemplary applications. For example, the principles, features and methods discussed may be applied to any medical or other tissue or treatment application.

Further, the principles of the present disclosure are described herein with continued reference to a foot for purposes of explanation. However, such principles may also be applied to other parts of a body, for example when an improvement of circulation is desired.

Significant health benefits can be achieved by utilization of an insole compression system. For example, health benefits comparable to or equal to the benefits arising from walking may be achieved. Moreover, exemplary insole compression systems are insertable and removable from conventional footwear, for example shoes, sneakers, boots, and/or the like. Thus, because exemplary insole compression systems are compact, portable, and discreet, user compliance may be greatly increased.

Moreover, prior compression systems were typically unable to deliver a near-linear or "constant" force curve. Stated another way, prior compression systems often varied wildly in the amount of force applied, for example based on the geometry of a particular foot as opposed to another foot, based on an extension distance of a pressure pad, and/or the like. In contrast, insole compression systems configured in accordance with principles of the present disclosure are able to deliver a more consistent force, even as foot geometries and extension distances vary. For example, an exemplary insole compression system is capable of delivering a force of 70 Newtons (+/−10%) over an extension range of 0 mm to about 15 mm, and irrespective of foot geometry.

An insole compression system may be any system configured to deliver a reciprocating compressive force to a portion of a living organism, for example a human foot, calf, or thigh. With reference now to FIGS. 1A through 1G, and in accordance with an exemplary embodiment, insole compression system 100 comprises an actuator 110, battery 130, insole 150, and control pad 170. Actuator 110 is configured to deliver a reciprocating compressive force to a portion of a living organism, preferably a human foot. Battery 130 supplies operational power to actuator 110. Insole 150 is insertable and removable from conventional footwear, and is configured to fully contain actuator 110 and battery 130. Control pad 170 controls operation of actuator 110, and may be external to insole 150 or fully contained therein. Moreover, insole compression system 100 may be configured with any appropriate components and/or elements configured to deliver a reciprocating compressive force to a portion of a living organism.

In certain exemplary embodiments, insole compression system 100 may comprise only actuator 110, battery 130, and control pad 170. In these embodiments, insole compression system 100 may be configured for installation into a separate insole.

Actuator 110 may be any device, system, or structure configured to apply a compressive force, for example to a foot. In an exemplary embodiment, actuator 110 is configured to be fully containable in a removable insole, for example an orthotic. Actuator 110 may be configured to be entirely contained within and/or integrated into an insole. For example, in various exemplary embodiments, actuator 110 is configured to be less than 0.5 inches thick. Moreover, actuator 110 may be removable from insole 150, for example via a snap fit, press fit, and/or the like.

With reference now to FIGS. 2A through 2E, in various exemplary embodiments, actuator 110 has an outer shape at least partially defined by a case 111. Case 111 may comprise multiple portions, for example upper case 111-A and lower case 111-B. Case 111 be formed of metal, plastic, composite, or other suitable durable material. Case 111 is configured to enclose various portions of actuator 110.

In accordance with an exemplary embodiment, pressure pad 112 comprises a rigid or semi-rigid structure configured to press against a person's foot. In various exemplary embodiments, pressure pad 112 is extendable and retractable. Moreover, pressure pad 112 may be rigid, semi-rigid, non-deformable, and/or non-bendable. Additionally, pressure pad may at least partially deformable and/or flexible, for example in order to at least partially conform to the dimensions of a portion of a human body.

Pressure pad 112 may be made of any suitable materials, for example metal, plastic, composite, and/or the like. In an exemplary embodiment, pressure pad 112 comprises nylon 6-6. Moreover, pressure pad 112 may be comprised of any material suitable for transferring force to a person's foot. Pressure pad 112 may also be monolithic. Alternatively, pressure pad 112 may comprise two or more individual components.

Pressure pad 112 may be at least partially pivotable, for example via disposition about center axle 115. In this manner, pressure pad 112 may more closely conform to a portion of a human body, for example a foot surface disposed at an angle relative to a fully retracted position or fully extended position of pressure pad 112.

Pressure pad 112 can be any size to transfer a desired amount of force to a person's foot. According to an exemplary embodiment, pressure pad 112 applies force directly to the arch region of the foot. In various exemplary embodiments, pressure pad 112 comprises a contact surface area in the range of about 6 square centimeters to about 30 square centimeters. In various exemplary embodiments, pressure pad 112 comprises a contact surface area in the range of about 10 square centimeters to about 24 square centimeters. In other exemplary embodiments, pressure pad 112 comprises a contact surface area in the range of about 18 square centimeters to about 23 square centimeters. However, pressure pad 112 may be configured with any appropriate dimensions, surfaces, angles, and/or components, as desired, in order to transfer force to a foot.

In certain exemplary embodiments, pressure pad 112 is configured with and/or coupled to a diffusion cap. The diffusion cap may be configured with dimensions approximating those of pressure pad 112 and/or slightly larger than pressure pad 112. The diffusion pad may comprise a suitable soft durable material, for example low density polyethylene plastic, elastomeric polyurethane, or foam having a thickness of between about 0.5 mm to about 1.25 mm. The diffusion cap may be attached to pressure pad 112, for example by adhesive, or may be molded directly onto or with pressure pad 112. The diffusion pad provides a softer element that pads pressure pad 112 from the foot; additionally, the extension of the diffusion pad around the edges of pressure pad 112 feathers the pressure of the edge to increase user comfort.

Via center axle 115, pressure pad 112 is coupled to a-frame 116. Moreover, pressure pad 112 may be configured to be moved by and/or coupled to any suitable power transfer components. Center axle 115 may comprise stainless steel or other suitable axle material as is known in the art. Center axle 115 forms a pivotable joint located at the peak of the "A" in a-frame 116.

In various exemplary embodiments, actuator 110 comprises a-frame 116. A-frame 116 may comprise two portions, for example a-frame 116-A and 116-B. A-frame 116-A and 116-B are at least partially pivotable about center axle 115, enabling a-frame 116 to "open" and "close". As a-frame 116 is closed, center axle 115 (and thus, pressure pad 112) is extended away from the portion of actuator 110 defined by case 111, and as a-frame 116 is opened, center axle 115 is retracted toward the portion of actuator 110 defined by case 111.

Torsion spring 114 is disposed about center axle 115. Torsion spring 114 is configured to impart a "closing" force to a-frame 116. Stated another way, torsion spring 114 is configured to impart an extension force to pressure pad 112. In certain exemplary embodiments, torsion spring 114 may be utilized alone in actuator 110; in other exemplary embodiments, torsion spring 114 may be utilized in connection with extension springs 118 to at least partially close a-frame 116.

In an exemplary embodiment, torsion spring 114 comprises piano wire. However, torsion spring 114 may comprise any suitable spring material as is known in the art. Torsion spring 114 may be configured with a suitable diameter and/or number of turns to exert a desired force on a-frame 116. In various exemplary embodiments, torsion spring 114 is configured with a wire diameter of between about 0.05" and about 0.08", and preferably about 0.0625". In various exemplary embodiments, torsion spring 114 is configured with between about 4 coils and about 7 coils, and preferable about 5.325 coils.

When a-frame 116 is opened, energy is stored in torsion spring 114. When a-frame 114 is closed, torsion spring 114 releases energy.

In various exemplary embodiments, in actuator 110 extension springs 118, for example extension springs 118-A and 118-B, are coupled to extension spring pins disposed in the ends of a-frame 116. Accordingly, extension springs 118 are configured to impart a "closing" force to a-frame 116. Stated another way, extension springs 118 are configured to impart an extension force to pressure pad 112. When a-frame 116 is opened, energy is stored in extension springs 118. When a-frame 114 is closed, extension springs 118 release energy.

In an exemplary embodiment, extension springs 118 comprise piano wire. However, extension springs 118 may comprise any suitable spring material as is known in the art. Extension springs 118 may be configured with a suitable length, diameter, spring rate, initial tension, and/or the like to exert a desired force on a-frame 116. In various exemplary embodiments, extension springs 118 are configured with an outer diameter of between about 0.15" and about 0.2", and preferably about 0.188". In various exemplary embodiments, extension springs 118 are configured with a length of between about 0.5" and about 0.6", and preferably about 0.56". In various exemplary embodiments, extension springs 118 are configured with a spring rate of between about 2 pounds per inch and about 4 pounds per inch, and preferably about 2.9 pounds per inch. In various exemplary embodiments, extension springs 118 are configured with an initial tension of between about 0.1 pound and about 0.3 pounds, and preferably about 0.2 pounds.

In actuator 110, torsion spring 114 and extension springs 118 provide stored energy for extension of pressure pad 112. Stated another way, actuator 110 may be considered to be "spring loaded" for extension. In contrast, in actuator 110, motor 124 applies a force for retraction of pressure pad 112. In various exemplary embodiments, force from motor 124 is applied to retract pressure pad 112 through lead nuts 120.

In various exemplary embodiments, a-frame 116, torsion spring 114, and extension springs 118 work in a complementary manner to provide a generally consistent extension force to pressure pad 112 as pressure pad 112 is extended, for example any suitable distance from about 0 mm to about 15 mm. Depending on foot shape, footwear, tightness of a footwear closure system, and other related factors, pressure pad 112 may impinge on a foot at a variety of extension heights; accordingly, in insole compression system 100 pressure pad 112 is desirably extended with a generally consistent force, for example in order to achieve efficient blood pumping action.

Figure 4:
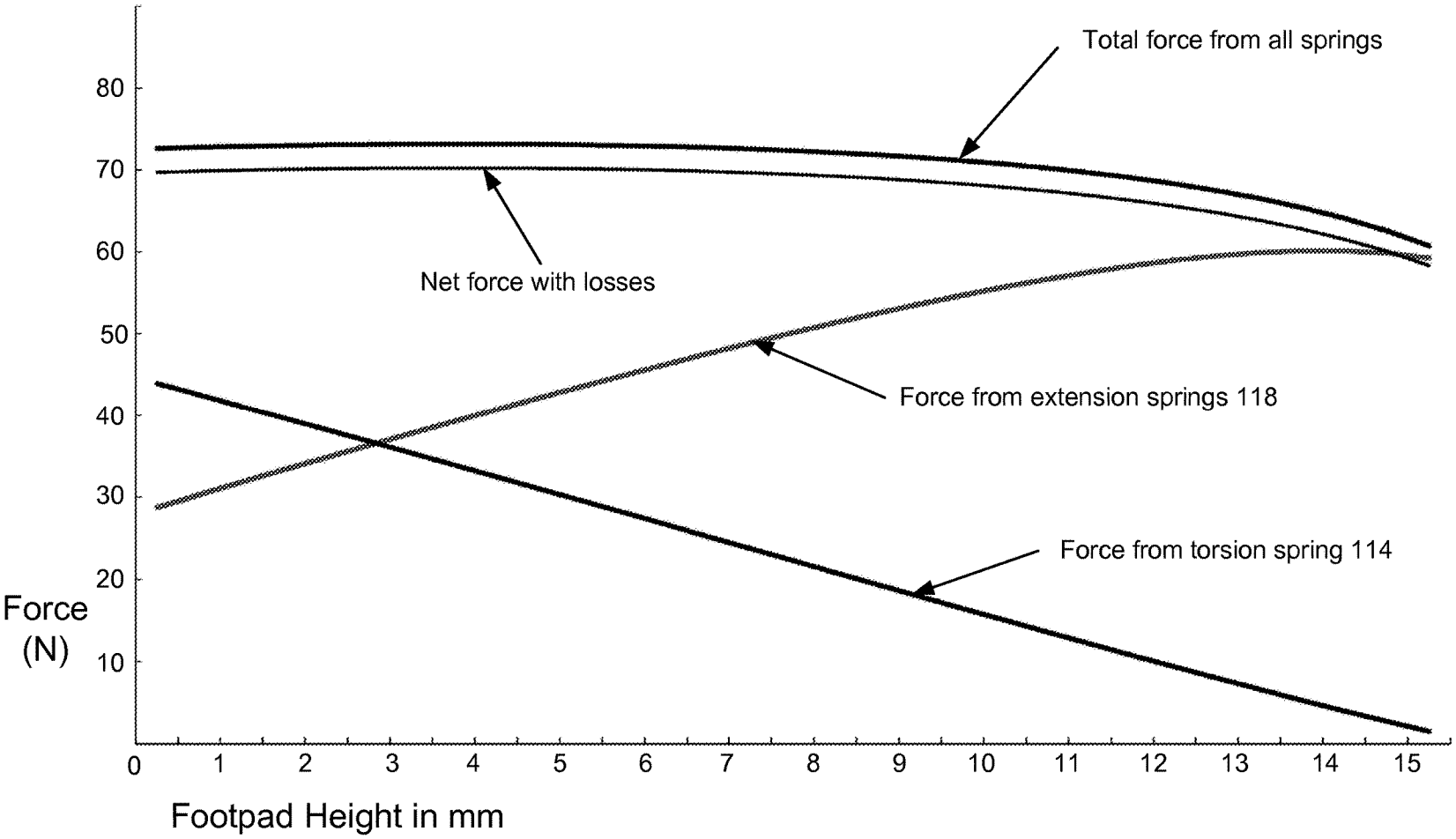
FIG. 4 illustrates operational performance of an insole compression system in accordance with an exemplary embodiment.

In various exemplary embodiments, and with momentary reference to FIG. 4, insole compression system 100 is configured to extend pressure pad 112 with a generally constant force of between about 50 Newtons and about 80 Newtons. This may be achieved via a balancing of the geometry of a-frame 116 and spring forces. For example, as a-frame 116 moves from an open position to a closed position, the bases of a-frame 116 react, for example against case 111, to push center axle 115 upward. As a-frame 116 closes, the reactive leverage changes; when a-frame 116 is open, the reactive leverage is much lower and more force is needed in order to lift center axle 115, while when a-frame 116 is closed to the midpoint and beyond, the reactive leverage greatly increases. Inversely, when torsion spring 114 and extension springs 118 are stretched into the open position for a-frame 116, torsion spring 114 and extension springs 118 apply a greater closing force than when they approach their relaxed positions as a-frame 116 is closed. Thus, the variable reactive leverage of a-frame 116 and the variable spring forces interact in a complementary way to provide an extension force for pressure pad 112 that is generally constant over the range of motion of pressure pad 112.

With reference now to FIG. 4, in various exemplary embodiments insole compression system 100 is configured with a constant or approximately constant extension force. It can be seen that force from extension springs 118 and force from torsion spring 114 vary inversely from one another as pressure pad 112 is extended; however, the net force exerted by insole compression system 110 remains approximately constant.

Returning now to FIGS. 2A through 2E, in various exemplary embodiments lead nuts 120, for example lead nuts 120-A and 120-B, are threaded about lead screw 122. Lead nuts 120 are disposed "inside" of a-frame 116 (i.e., the respective ends of a-frame 116 are located between lead nuts 120 and the outside of case 111). Lead nuts 120 may comprise any suitable durable material, for example metal, nylon 6-6 impregnated with fiberglass, and/or the like. Lead nuts 120 are configured to transfer a force generated by motor 126 to cause pressure pad 112 to retract.

Lead nuts 120 may abut a-frame 116 but are not coupled thereto. Stated another way, responsive to rotation of lead screw 122 in a first direction, lead nuts 120 may push "outward" on lower portions of a-frame 116 to force a-frame 116 toward a fully opened position. However, if lead screw 122 is rotated in a second, opposite direction, lead nuts 120 do not pull a-frame 116 "inward" toward a fully closed position; rather, a-frame 116 is closed via application of forces from torsion spring 114 and/or extension springs 118. In this manner, certain components in actuator 110 are protected from excessive external forces exerted on pressure pad 112, for example a force applied by a user standing. Responsive to the applied external force, a-frame 116 simply opens at least partially or fully (depending on the strength of the force) toward the fully open position, thus retracting pressure pad 112. Because a-frame 116 may be considered to "float" with respect to lead screws 122 in one direction, motor 126 and gearbox 124 are protected from damage, and a clutch or other disengagement elements are unnecessary for inclusion in actuator 110. Moreover, a user of insole compression system 100 is likewise protected from injury, as the force applied to the foot cannot exceed the force generated by torsion spring 114, extension springs 118, and a-frame 116.

Lead screw 122 transfers force from gearbox 124 to lead nuts 120. Lead screw 122 may comprise any suitable durable material, for example high grade stainless steel. In one exemplary embodiment, lead screw 122 may be configured with a 4 mm outer diameter having three thread starts in a 3 mm pitch. Moreover, any suitable diameter, number of threads, and thread pitch may be utilized. Lead screw 122 may be configured with a right hand thread on one portion, and a left hand thread on the other portion, in order to move lead nuts 120 inward or outward simultaneously as lead screw 122 is turned in either direction.

Gearbox 124 couples motor 126 and lead screw 122. Gearbox 124 comprises a mechanism configured to increase the mechanical advantage obtained by motor 126, for example a reduction gearbox. Output force from motor 126 is transferred through gearbox 124 in order to achieve an appropriate gear ratio for effectuating movement of pressure pad 112. Thus, gearbox 124 may have a fixed gear ratio. Alternatively, gearbox 124 may have a variable or adjustable gear ratio. Gearbox 124 may comprise any suitable ratio configured in any suitable matter to effectuate movement of pressure pad 112. In certain exemplary embodiments, gearbox 124 is configured with a gear ratio of between about 88:1 to about 150:1. It will be appreciated that various gear ratios for gearbox 124 may be utilized in connection with configuration of lead screw 122, a-frame 116, and motor 126 in order to achieve a desired leverage and speed of operation for insole compression system 100. Moreover, gearbox 124 may comprise any suitable components, configurations, ratios, mechanisms, and/or the like, as desired, in order to transfer output force from motor 126 to other components of actuator 110, for example lead screw 122.

Motor 126 may be any component configured to generate mechanical force to retract pressure pad 112. In accordance with an exemplary embodiment, motor 126 comprises a rotary output shaft driving a pinion. Motor 1126 may comprise any suitable motor, such as a brushless direct current (DC) motor, a brushed DC motor, a coreless DC motor, a linear DC motor, and/or the like. Moreover, any motor, actuator, micro-engine, or similar device presently known or adopted in the future to drive moving parts within actuator 110 falls within the scope of the present disclosure.

In actuator 110, motor 126 provides power to "cock" actuator 110 such that pressure pad 112 is ready for extension utilizing stored energy springs. Stated another way, in actuator 110, motor 126 drives a-frame 116 toward and/or into an opened position, but not a closed position. Opening movement of a-frame 116 stores energy in torsion spring 114 and extension springs 118. Responsive to a control input from control pad 170, a-frame 116 is released, for example via a switch, and moves toward and/or into a closed position under the influence of springs 114 and 118, extending pressure pad 112. Motor 126 thereafter operates to retract pressure pad 112, and the cycle may be repeated, as desired.

In various exemplary embodiments, pressure pad 112 is extended via operation of insole compression system 100 at a speed that is optimized to generate a target velocity for blood pumped up a leg of a user of insole compression system 100. Accordingly, in certain exemplary embodiments, insole compression system 100 is configured to extend pressure pad 112 a distance of about 15 mm over a time of from about 0.45 seconds to about 0.55 seconds, and preferably about 0.5 seconds. It will be appreciated that a-frame 116, lead nuts 120, lead screw 122, gearbox 124, and motor 126 are desirably configured to allow a-frame 116 to close within the desired timeframe.

In accordance with various exemplary embodiments, insole compression system 110 may comprise a sensor 125, for example sensor 125 disposed generally on top of battery 130. It will be appreciated that this location places sensor 125 desirably beneath the heel of a user of insole compression system 100. Sensor 125 may comprise any suitable sensor configured to detect applied weight and/or momentum. In certain exemplary embodiments, sensor 125 comprises a piezoelectric shock sensor; moreover, sensor 125 may be configured with an adjustable sensitivity in order to be tailored to the specific needs of a particular user. When sensor 125 detects a suitable amount of weight or momentum, such as 25 pounds or more, control pad 170 may infer that a person is walking (i.e., not sitting or reclining) or otherwise putting pressure on actuator 110. Moreover, any appropriate weight may be utilized, and thus falls within the scope of the present disclosure. Accordingly, control pad 170 may implement a delay in activating insole compression system 100 to ensure pressure pad 112 is not extended at an undesirable time. In various exemplary embodiments, responsive to sensor 125 detecting a suitable applied weight or momentum, control pad 127 may implement a delay of 30 seconds, one minute, two minutes, and/or the like, and thereafter resume normal operation until sensor 125 detects a suitable applied weight or momentum. Additionally, if sensor 125 detects an applied weight or momentum during a delay period, the delay timer may be reset and the delay period begins again.

In accordance with an exemplary embodiment, pressure pad 112 may be kept in an extended position for a time between about 1 and 5 seconds. In various exemplary embodiments, pressure pad 112 is pressed against the venous plexus region of the foot for a time between approximately 1 and 5 seconds, and preferably closer to 2 seconds. When extended away from depressor housing 111, pressure pad 112 presses against the venous plexus region of the foot. Pressure pad 112 compresses the veins both in the arch of the foot and across the top of the foot from approximately the metatarsal-phalangeal joints to the talus. However, principles of the present disclosure contemplate pressure pad 112 pressing against any desired site on a body and being kept in an extended position for any suitable time, for example to stimulate blood flow.

In an exemplary embodiment, pressure pad 112 is configured to extend and/or retract over a desired time period. In various exemplary embodiments, pressure pad 112 is configured to extend from a fully refracted position to a fully extended position in a time between about 0.5 seconds and about 1.5 seconds, and preferably about 0.8 seconds. In various exemplary embodiments, pressure pad 112 is configured to retract from a fully retracted position to a fully extended position in a time between about 0.5 seconds and about 1.5 seconds, and preferably about 0.9 seconds. However, pressure pad 112 may be configured to extend and/or retract over any suitable time period. Moreover, variances in between individuals (e.g., the unique features of a foot such as height of arch, curvature of arch, width, length, and/or the like) may affect the time period over which pressure pad 112 is deployed.

In an exemplary embodiment, pressure pad 112 retracts so that it is flush or nearly flush, for example with an outer surface of insole 150. In this manner, insole compression system 100 may be "concealed" from the sensation of the wearer when not in operation, so that the wearer experiences the sensation of wearing a conventional insole or orthotic. Compression, for example of the venous plexus, expels blood up the lower leg and is then followed by a period of non-compression to allow the veins, for example of the venous plexus, to re-fill with blood. In various exemplary embodiments, pressure pad 112 is pressed against the venous plexus region of the foot and then retracted in regular intervals of between about 10 seconds to about 45 seconds, and preferably between 20 seconds to 45 seconds. However, pressure pad 112 may be pressed against the venous plexus region of the foot and then retracted in any suitable interval, for example to stimulate blood flow. Moreover, in addition to the amount of pressure applied, compression may be rapid (for example, by raising pressure pad 112 within a time interval of between about 0.45 seconds and about 0.55 seconds) in order to move blood through the veins of the lower leg at an elevated velocity and to release chemical compounds that reduce pain.

While specific time ranges, sizes, pressures, movement distances, and the like have been described herein, these values are given purely for example. Various other time ranges, sizes, pressures, distances, and the like can be used and fall within the scope of the present disclosure. Any device configured to apply pressure to a person's foot as set forth herein is considered to fall within the scope of the present disclosure.

Figure 3A:
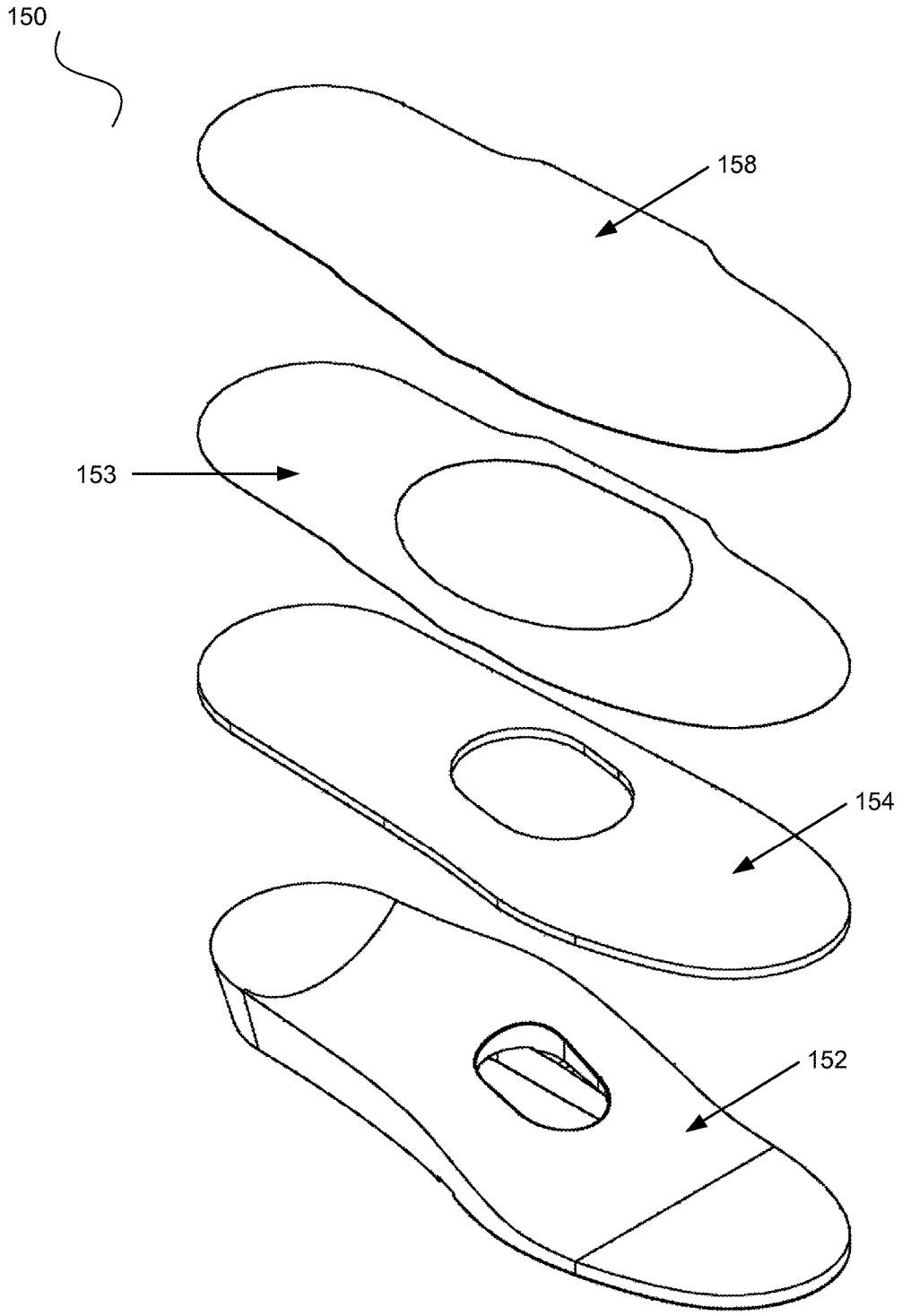
FIG. 3A illustrates components of an insole portion of an insole compression system in accordance with an exemplary embodiment.
Figure 3B:
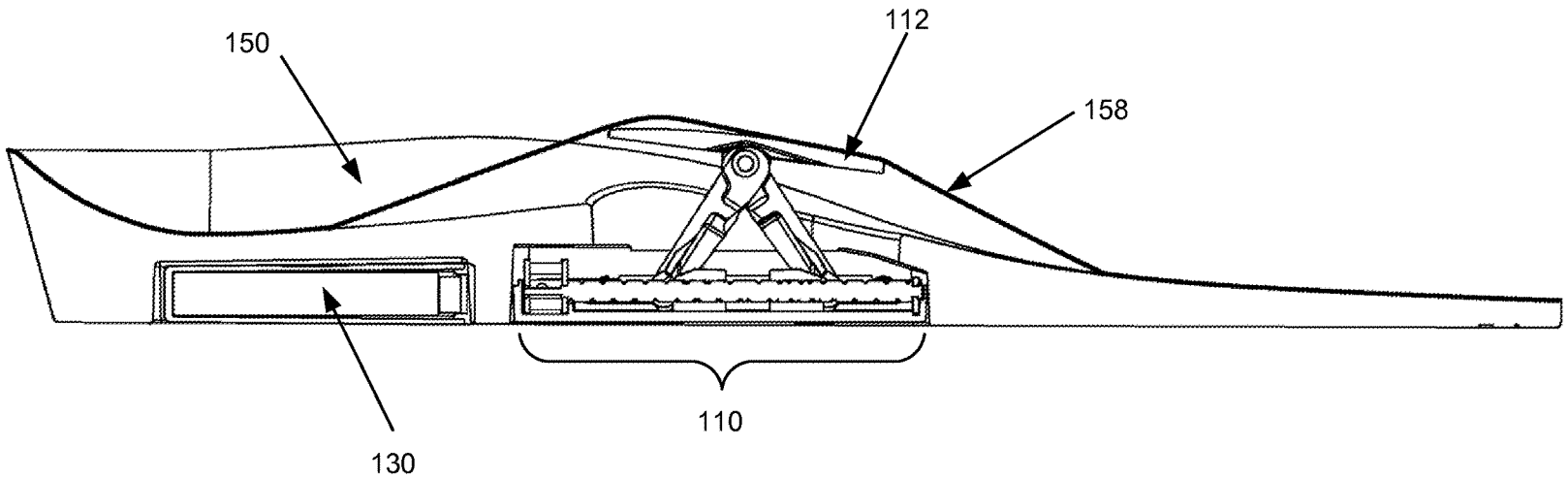
FIG. 3B illustrates a cut-away view of an insole compression system having a pressure pad extended in accordance with an exemplary embodiment.

Turning now to FIGS. 3A and 3B, in various exemplary embodiments, insole 150 is configured to support, contain, and/or house components of insole compression system 100. In an exemplary embodiment, insole frame 152 comprises a durable material, for example molded hard polyurethane foam having a density of between about 10 pounds and about 15 pounds per square foot (i.e., about shore A 65). Insole frame 152 is configured with a cavity to receive battery 130, a cavity to receive actuator 110, and an aperture to permit extension and refraction of pressure pad 112.

Insole 150 may further comprise a foam or other padding layer 154, for example EVA foam having a thickness of between about 0.5 mm and about 2 mm and a density of between about 4 pounds and about 6 pounds.

Insole 150 may comprise a stretchable and/or waterproof top layer, for example, stretch sheet 158. Stretch sheet 158 may comprise any suitable flexible material or materials, for example a poly elastane 4-way stretch tricot fabric, and may be configured with a stretch urethane, silicone, or stretch rubber coating for waterproofing. Stretch sheet 158 is configured to accommodate extension and retraction of pressure pad 112 therebeneath, preventing entrapment of sock, dirt, or other fabric elements during operation of insole compression system 100. Components of insole 150 may be coupled and/or bonded via any suitable method or materials, for example permanent glues, adhesives (for example, layers of pressure sensitive adhesive 153), and/or the like. In various exemplary embodiments, adhesive holds stretch sheet 158 to at least a portion of a padding layer 154 and/or insole frame 152, while leaving an unsecured portion generally around the area where pressure pad 112 will extend. In this manner, stretch sheet 158 may locally extend and/or deform responsive to movement of pressure pad 112 while maintaining a barrier between the foot of a user and other components of insole compression system 100.

Insole 150 is configured to be completely insertable in (and removable from) a conventional item of footwear. In this manner, insole compression system 110 can be portable, convenient, replaceable, discreet, and inexpensive. Moreover, users can obtain benefits associated with operation of insole compression system 100 without having to purchase specialized footwear.

With reference again to FIGS. 1A through 1F, in various exemplary embodiments, insole compression system 100 may comprise various sensors, for example pressure sensors, weight sensors, strain gauges, accelerometers, motion sensors and/or the like. In one embodiment, actuator 110 may utilize one or more sensors for monitoring and/or control of insole compression system 100. For example, in certain exemplary embodiments it may be desirable to prevent extension of pressure pad 112 when a person is walking or applying body weight to actuator 110. Thus, control pad 170 may prevent extension of pressure pad 112, for example, in response to sensor input indicating a person is walking (e.g., accelerometer readings, weight sensor readings, motion sensor readings, and/or the like).

In various exemplary embodiments, insole compression system 100 may be configured to be turned "on" when a user is seated and/or recumbent, and configured to be turned to a "standby" mode when a user is standing and/or walking. In an exemplary embodiment, control pad 170 may prevent operation of insole compression system 100 unless the sensor reports to control pad 170 that the person utilizing insole compression system 100 has been seated or otherwise stationary or recumbent for a suitable period of time, e.g. between 2 and 10 minutes.

In an exemplary embodiment, control pad 170 is releasably attached to actuator 110, for example via durable flat wire, in order to control and/or operate insole compression system 100. A spring clip on one side of control pad 170 facilitates coupling to laces or other portions of footwear. Control pad 170 may be configured with and/or comprise electronic buttons, switches, or similar devices. In various exemplary embodiments, control pad 170 comprises a control button, together with LED indicators for function. Additionally, control pad 170 may comprise a communications port, for example a Universal Serial Bus (USB) port, for example for battery charging, data transfer, and/or the like. Moreover, control pad 170 may be coupled to other components of insole compression system 100 and/or external components, for example via a wireless connection such as Bluetooth. Further, control pad 170 may comprise variable pressure control switches with corresponding indicator lights. Control pad 170 may also comprise variable speed control switches with corresponding indicator lights, on/off switches, pressure switches, click wheels, trackballs, d-pads, and/or the like. Control pad 170 may comprise any suitable components configured to allow a user to control operation of insole compression system 100.

In various exemplary embodiments, insole compression system 100 may be at least partially operated, controlled, and/or activated by one or more electronic circuits, for example control pad 170. In accordance with an exemplary embodiment, example control pad 170 and/or an associated software subsystem comprise components configured to at least partially control operation of actuator 110. For example, example control pad 170 may comprise integrated circuits, discrete electrical components, printed circuit boards, and/or the like, and/or combinations of the same. Control pad 170 may further comprise clocks or other timing circuitry. Control pad 170 may also comprise data logging circuitry, for example volatile or non-volatile memories and the like, to store data, such as data regarding operation and functioning of actuator 110. Moreover, a software subsystem may be pre-programmed and communicate with control pad 170 in order to adjust various variables of actuator 110, for example pressure pad extension duration and/or the like. Additionally, control pad 170 may be wirelessly coupled to actuator 110; moreover, actuator 110 may include wireless components for direct communication with a smartphone, tablet, smart watch, and/or the like. In this manner, operation of insole compression system 100 may be governed and/or controlled, for example via a software application operative on a smartphone.

Control pad 170 may be configured to store data related to insole compression system 100. For example, in various exemplary embodiments, control pad 170 may record if insole compression system 100 is mounted to the foot of a person and active, if insole compression system 100 is mounted to the foot of a person and inactive, if insole compression system 100 is not mounted to the foot of a person and insole compression system 100 is inactive, and/or the like and/or combinations of the same.

Further, control pad 170 may record the duration insole compression system 100 is active, the number of compression or stimulation cycles performed, the parameters under which the cycles where performed by insole compression system 100, and so forth. Moreover, control pad 170 may further comprise circuitry configured to enable data stored in control pad 170 to be retrieved for analysis, deleted, compacted, encrypted, and/or the like. Control pad 170 may be removably or permanently coupled to actuator 110, for example via a flat wire, a wireless link, and/or the like.

In accordance with an exemplary embodiment, insole compression system 100 further comprises battery 130. The battery may comprise electrochemical cells suitable to provide power for the various components of insole compression system 100, such as actuator 110. Battery 130 may be rechargeable, but may also be single-use. Battery 130 may comprise alkaline, nickel-metal hydride, lithium-ion, lithium-polymer, and/or other battery configurations suitable for powering actuator 110. Moreover, battery 130 may comprise any suitable chemistry, form factor, voltage, and/or capacity suitable to provide power to insole compression system 100. Battery 130 may be decoupled from insole 150, for example to facilitate recharging of the battery, as desired. Alternatively, battery 130 may recharge by connecting to a power supply via a cable without having to decouple the battery from insole 150. In certain exemplary embodiments, battery 130 is coupled to actuator 110 and thereby to control pad 170; in this manner, battery 130 may be charged, for example via a USB connection to control pad 170.

In various exemplary embodiments, insole compression system 100 may be entirely self-contained; stated another way, insole compression system 100 may be configured as a stand-alone unit wherein all components necessary for operation of insole compression system 100 are contained within and/or physically coupled to insole 150.

In various exemplary embodiments, insole compression system 100 may be coupled to, utilized with, and/or integrated with a compression garment, for example a compression sock. The compression sock may be configured to work in a complementary manner with insole compression system 100, for example in order to treat and/or prevent deep vein thrombosis, to facilitate athletic recovery, and/or the like.

In certain exemplary embodiments, insole compression system 100 is configured for use in, complementary to, and/or as a substitute for low-intensity physical exertion after a workout. Stated another way, insole compression system 100 is configured to facilitate "athletic recovery," or the augmentation of blood flow in the body's venous system to deliver nutrients to the muscles while simultaneously removing lactic acid and metabolic waste. After a workout, it has been found that a person may recover more quickly from the after-effects of exercise (for example, accumulation of lactates in the muscle and/or blood) via low-intensity physical exertion rather than via complete rest. The increased blood circulation attendant to low-intensity physical exertion facilitates the removal of cellular metabolic waste and lactic acid from muscle and the reduction of lactate levels in the bloodstream. Additionally, physical exertion can facilitate facilitating opening the capillary bed to enable remedial hydration and/or efficient nutrient transfer. In contrast, post-workout periods of immobility, for example either sitting or recumbent, do little physiologically to promote athletic recovery. Lowered venous peak velocity and reduced circulation closes the capillaries and locks lactic acid in place, which influences swelling and muscle soreness. Moreover, sitting with hips and knees in flexion, with bends of 60 to 90 degrees in the knees and hips, can kink the arterial blood supply and venous return, elevating the risk of edema stasis, toxin storage, and nutrient deficiency.

Therefore, by promoting blood circulation, insole compression system 100 may be utilized to achieve similar benefits as those obtained via low-intensity physical exertion. For example, insole compression system 100 may be utilized to achieve augmentation of peak venous velocity, augmentation of venous volume return, and/or augmentation of fibrinolysis. Additionally, the increased venous outflow evacuates cellular metabolic waste products and reduces excess fluid trapped in the soft tissues of the lower leg, thereby promoting arterial inflow to the vacated capillary bed. Lower leg edema and other significant risk factors are reduced and/or eliminated. Stated another way, via use of insole compression system 100, a person may achieve similar results as those achieved via low aerobic activity such as walking but without actually walking. The user achieves augmented venous outflow despite being in a seated and/or recumbent position.

In an exemplary embodiment, insole compression system 100 may be used by a person as part of a "cool down" process during the "golden hour"—approximately the first 60 minutes immediately after a workout. In other exemplary embodiments, insole compression system 100 may be used during a predetermined period after a workout, for example between immediately after a workout to about 12 hours after a workout. Insole compression system 100 may be utilized after a workout for a suitable duration, for example a duration of between about 10 minutes to about 2 hours, in order to assist in athletic recovery. While residual cellular metabolic waste can take several days to flush from the soft tissues, this process can be greatly accelerated via use of insole compression system 100 after a workout. To facilitate use of insole compression system 100 as part of an athletic recovery program, insole compression system 100 may be inserted into athletic footwear intended for use during a workout. Moreover, insole compression system 100 may also be inserted into post-exercise footwear.

Insole compression system 100 may be utilized on a regular schedule by a person, for example as part of a pre-workout warmup, a post-workout cooldown, and/or on days when no workout is scheduled. By increasing blood flow, insole compression system 100 can facilitate improved muscle readiness prior to exercise, quicker post-exercise recovery, and/or improved circulation on days absent strenuous exercise. In particular, insole compression system 100 may be desirably utilized by athletes subsequent to athletic events in order to facilitate faster recovery.

In an exemplary embodiment, actuator 110 is configured to repeatedly compress the venous plexus region of the foot as discussed herein.

Figure 5A:
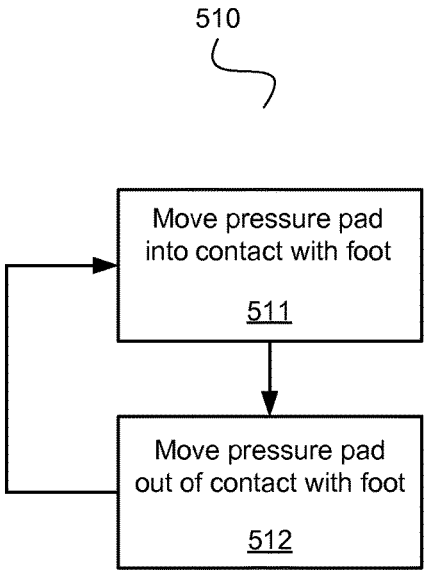
FIGS. 5A, 5B, 6, 7, 8, 9, 10, and 11 illustrate methods of using an exemplary insole compression system in accordance with various exemplary embodiments.
Figure 5B:
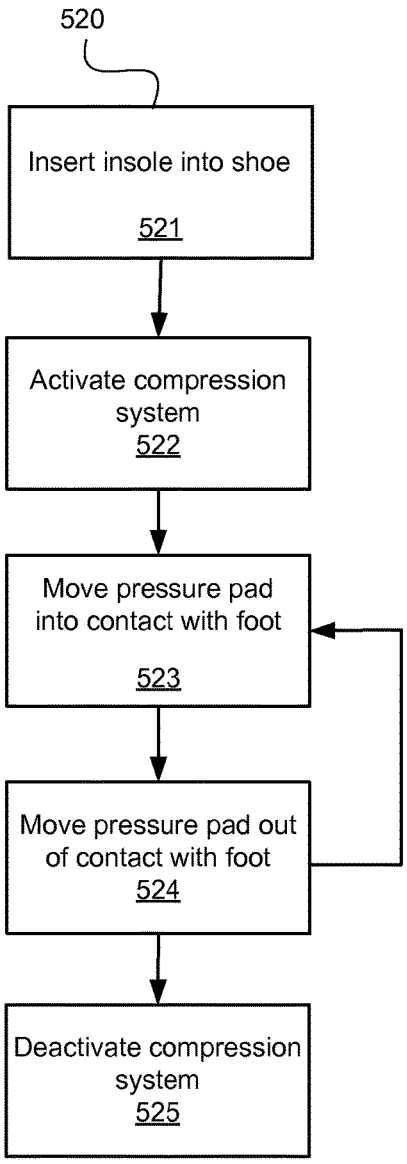

Turning now to FIG. 5A, in accordance with an exemplary embodiment a method 510 for generally enhancing circulation and/or implementing athletic recovery in a person following exercise comprises moving a pressure pad into contact with a foot (step 511), and moving a pressure pad out of contact with the foot (step 512). The pressure pad may be repeatedly moved as described above in order to facilitate blood flow. With reference to FIG. 5B, in accordance with an exemplary embodiment a method 520 also for enhancing circulation and/or implementing athletic recovery following exercise comprises inserting an insole compression system into a shoe (step 521), activating the insole compression system (step 522), moving a pressure pad into contact with a foot (step 523), moving a pressure pad out of contact with the foot (step 824), and deactivating the insole compression system (step 825). Steps 523 and 524 may be repeated, as desired.

Other exemplary embodiments may comprise utilizing insole compression system 100 prior to an athletic event, participating in the athletic event, and utilizing insole compression system 100 subsequent to the athletic event. Each of these steps may comprise any suitable use of insole compression system 100, for example method 510 or 520. Moreover, these steps may be performed at any suitable time prior to and/or subsequent to the athletic event, and insole compression system 100 may be utilized for any desired length of time (for example, 15 minutes, 30 minutes, one hour, and/or the like). Moreover, insole compression system 100 may be utilized for a length of time specified by a physician.

In various exemplary embodiments, insole compression system 100 is configured for use by individuals who are in fixed, standing, and/or sitting positions for extended periods of time, for example office workers, pregnant women, passengers on long-haul airline flights in excess of four hours, individuals in wheelchairs, service workers whose positions require standing, hospital patients, and/or the like. By improving blood flow in the lower extremities and legs, insole compression system 100 can reduce the negative health impacts associated with extended standing, extended sitting, and/or reduced mobility or immobility of a portion of the body. Moreover, insole compression system 100 may be configured for use in connection with the removal of metabolic waste, wound care and recovery, or the treatment of medical conditions including plantar fasciitis, restless leg syndrome, deep vein thrombosis, pulmonary embolism, and venous insufficiency.

Figure 6:
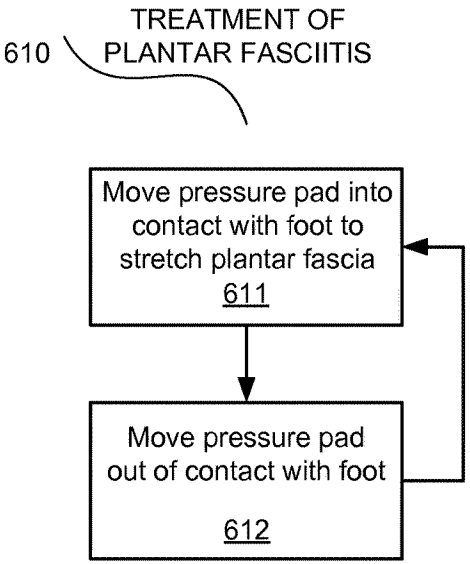

In various exemplary embodiments, with reference now to FIG. 6, insole compression system 100 may be utilized in connection with treatment of plantar fasciitis. In these embodiments, activation of insole compression system 100 is not primarily directed to increasing circulation and/or vascularity (though these results may be present); rather, activation of insole compression system 100 is directed to stretching, massaging, and/or otherwise treating the plantar fascia and/or the surrounding tissue and components of the foot. In an exemplary embodiment, insole compression system 100 is utilized to stretch the plantar fascia via extension of pressure pad 112.

In an exemplary embodiment, in connection with a method 610 for treating plantar fasciitis, pressure pad 112 is extended into contact with a foot in order to stretch the plantar fascia. Pressure pad 112 may be placed in contact with a foot (step 611) for a desired period of time in order to stretch the plantar fascia. In accordance with an exemplary embodiment, pressure pad 112 may be extended with a force between about 50 Newtons and about 80 Newtons in certain exemplary embodiments. Pressure pad 112 may be kept in an extended position for a time between about 1 second and about 6 seconds. Pressure pad 112 is then retracted (step 612). Pressure pad 112 may then be re-extended (step 611), such as after a delay of between about 10 and 60 seconds. However, other time frames can be used, and all suitable time frames are thought to fall within the scope of the present disclosure.

In various exemplary embodiments, when utilized for treatment of plantar fasciitis, insole compression system 100 may be utilized any suitable number of times in a day. In an exemplary embodiment, insole compression system 100 is used for treatment of plantar fasciitis once a day. In another exemplary embodiment, insole compression system 100 is used for treatment of plantar fasciitis twice a day. Moreover, insole compression system 100 may also be used more than twice a day, on alternating days, and/or on any other suitable time schedule, as desired.

In various exemplary embodiments, when utilized for treatment of plantar fasciitis, insole compression system 100 may be utilized for any suitable duration. In an exemplary embodiment, insole compression system 100 is used for treatment of plantar fasciitis for about 30 minutes at a time. In another exemplary embodiment, insole compression system 100 is used for treatment of plantar fasciitis for about one hour at a time. Moreover, insole compression system 100 may be used for between about fifteen minutes and about eight hours at a time, and/or for any other suitable duration, as desired.

Figure 7:
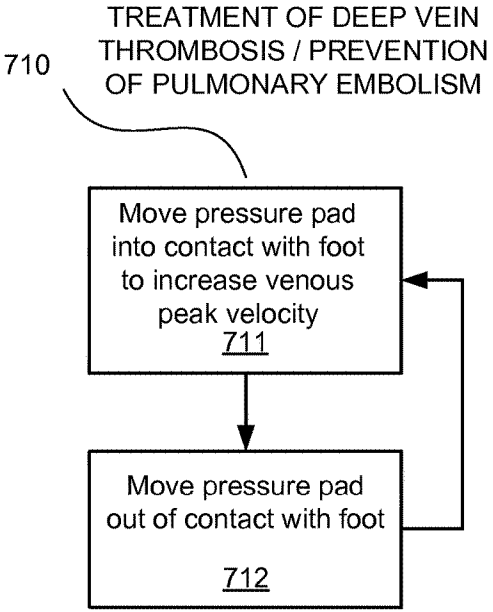

Turning now to FIG. 7, in various exemplary embodiments, insole compression system 100 may be utilized in connection with treatment of deep vein thrombosis and/or prevention of pulmonary embolism. In these embodiments, activation of insole compression system 100 may be primarily directed to increasing venous peak velocity. Additionally, improved circulation and/or vascularity may be achieved. In an exemplary embodiment, insole compression system 100 is utilized to increase venous peak velocity via extension of pressure pad 112.

In an exemplary embodiment, in connection with a method 710 for treatment of deep vein thrombosis and/or prevention of pulmonary embolism, pressure pad 112 is extended into contact with a foot in order to force blood through the venous plexus. Pressure pad 112 may be placed in contact with a foot (step 711) for a desired period of time in order to force blood through the venous plexus. Pressure pad 112 may be extended with a force between about 50 Newtons and about 80 Newtons in certain exemplary embodiments. Pressure pad 112 may be kept in an extended position for a time between about 1 and 3 seconds. Pressure pad 112 is then retracted (step 712). Pressure pad 112 may then be re-extended (repeated step 711), such as after a delay of between about 20 and 40 seconds. However, other time frames can be used, and all suitable time frames are thought to fall within the scope of the present disclosure.

In various exemplary embodiments, in connection with a method 1010 for treatment of deep vein thrombosis and/or prevention of pulmonary embolism, extension of pressure pad 112 is configured to raise the peak femoral venous velocity in a patient via compression of the venous plexus. In an exemplary embodiment, compression of the venous plexus via extension of pressure pad 112 results in peak femoral venous velocity in excess of 30 centimeters per second (cm/s). In another exemplary embodiment, compression of the venous plexus via extension of pressure pad 112 results in peak femoral venous velocity in excess of 40 cm/s. In another exemplary embodiment, compression of the venous plexus via extension of pressure pad 112 results in peak femoral venous velocity in excess of 45 cm/s. Moreover, insole compression system 100 may be utilized to compress the venous plexus in order to achieve any suitable peak femoral venous velocity in a patient, and the foregoing examples are by way of illustration and not of limitation.

In various exemplary embodiments, when utilized for treatment of deep vein thrombosis and/or prevention of pulmonary embolism, insole compression system 100 may be utilized any suitable number of times in a day. In an exemplary embodiment, insole compression system 100 is used for treatment of treatment of deep vein thrombosis and/or prevention of pulmonary embolism once a day. In another exemplary embodiment, insole compression system 100 is used for treatment of deep vein thrombosis and/or prevention of pulmonary embolism twice a day. Moreover, insole compression system 100 may also be used more than twice a day, on alternating days, continuously, and/or on any other suitable time schedule, as desired.

In various exemplary embodiments, when utilized for treatment of deep vein thrombosis and/or prevention of pulmonary embolism, insole compression system 100 may be utilized for any suitable duration. In an exemplary embodiment, insole compression system 100 is used 24 hours a day. In another exemplary embodiment, insole compression system 100 is used for treatment of deep vein thrombosis and/or prevention of pulmonary embolism for about 12 hours at a time. Moreover, insole compression system 100 may be used for between about three hours and about 6 hours at a time, and/or for any other suitable duration, as desired.

Figure 8:
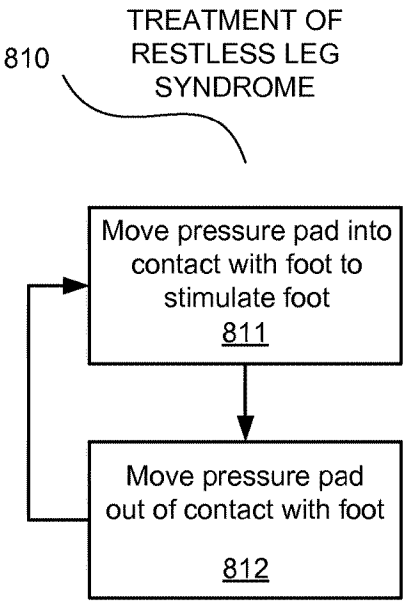

Turning now to FIG. 8, in various exemplary embodiments, insole compression system 100 may be utilized in connection with treatment of restless leg syndrome. In these embodiments, use of insole compression system 100 may be directed to increasing blood flow in the foot and/or leg, stimulation of nerves in the foot and/or leg, and/or the like. Additionally, improved circulation and/or vascularity may be achieved. In an exemplary embodiment, insole compression system 100 is utilized to stimulate the foot via extension of pressure pad 112.

In an exemplary embodiment, in connection with a method 810 for treating restless leg syndrome, pressure pad 112 is extended into contact with a foot in order to stimulate the foot. Pressure pad 112 may be placed in contact with a foot (step 811) for a desired period of time in order to stimulate the foot. Pressure pad 112 may be extended with a force between about 50 Newtons and 80 Newtons in certain exemplary embodiments. Pressure pad 112 may be kept in an extended position for a time between about 1 and 3 seconds. Pressure pad 112 is then retracted (step 812). Pressure pad 112 may then be re-extended (repeated step 811), such as after a delay of between about 20 and 30 seconds. However, other time frames can be used, and all suitable time frames are thought to fall within the scope of the present disclosure.

In various exemplary embodiments, when utilized for treatment of restless leg syndrome, insole compression system 100 may be utilized any suitable number of times in a day. In an exemplary embodiment, insole compression system 100 is used for treatment of restless leg syndrome once a day, for example between about 1 hour and about 3 hours before retiring to bed. In another exemplary embodiment, insole compression system 100 is used for treatment of restless leg syndrome twice a day, for example within about 1 hour and about 3 hours of arising in the morning, and between about 1 hour and about 3 hours before retiring to bed. Moreover, insole compression system 100 may also be used more than twice a day, on alternating days, and/or on any other suitable time schedule, as desired. In certain exemplary embodiments, insole compression system 100 may be utilized on an "as-needed" basis to treat symptoms of restless leg syndrome in real-time as they are occurring.

In various exemplary embodiments, when utilized for treatment of restless leg syndrome, insole compression system 100 may be utilized for any suitable duration. In an exemplary embodiment, insole compression system 100 is used for treatment of restless leg syndrome for between about one hour and about three hours at a time. Moreover, insole compression system 100 may be used for any other suitable duration, as desired.

Figure 9:
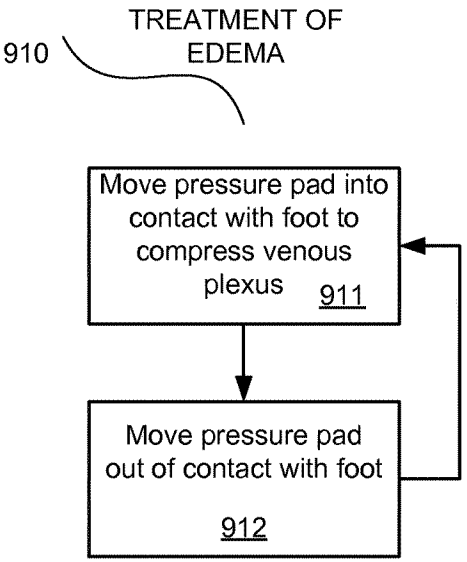

Turning now to FIG. 9, in various exemplary embodiments, insole compression system 100 may be utilized in connection with treatment of edema. In these embodiments, activation of insole compression system 100 may be directed to increasing circulation and/or vascularity in a portion of a human body. In an exemplary embodiment, insole compression system 100 is utilized to compress the venous plexus region of the foot via extension of pressure pad 112.

In an exemplary embodiment, in connection with a method 910 for treating edema, pressure pad 112 is extended into contact with a foot in order to force blood from the venous plexus region of the foot. Pressure pad 112 may be placed in contact with a foot (step 911) for a desired period of time in order to force blood from the venous plexus. In accordance with an exemplary embodiment, Pressure pad 112 may be extended with a force between about 50 Newtons and 80 Newtons in certain exemplary embodiments. Pressure pad 112 may be kept in an extended position for a time between about 1 second and about 5 seconds. Pressure pad 112 is then retracted (step 912) in order to allow the venous plexus to at least partially refill with blood. Pressure pad 112 may then be re-extended (repeated step 911) to force blood from the venous plexus, such as after a delay of between about 30 seconds and about 60 seconds. However, other time frames can be used, and all suitable time frames are thought to fall within the scope of the present disclosure.

In various exemplary embodiments, when utilized for treatment of edema, insole compression system 100 may be utilized any suitable number of times in a day. In an exemplary embodiment, insole compression system 100 is used for treatment of edema once a day. In another exemplary embodiment, insole compression system 100 is used for treatment of edema twice a day. Moreover, insole compression system 100 may also be used more than twice a day, on alternating days, and/or on any other suitable time schedule, as desired. In certain exemplary embodiments, insole compression system 100 may be utilized on an "as-needed" basis to treat symptoms of edema in real-time, for example responsive to patient discomfort.

In various exemplary embodiments, when utilized for treatment of edema, insole compression system 100 may be utilized for any suitable duration. In an exemplary embodiment, insole compression system 100 is used for treatment of edema for between about one hour and about eight hours at a time. Moreover, insole compression system 100 may be used for any other suitable duration, as desired.

Figure 10:
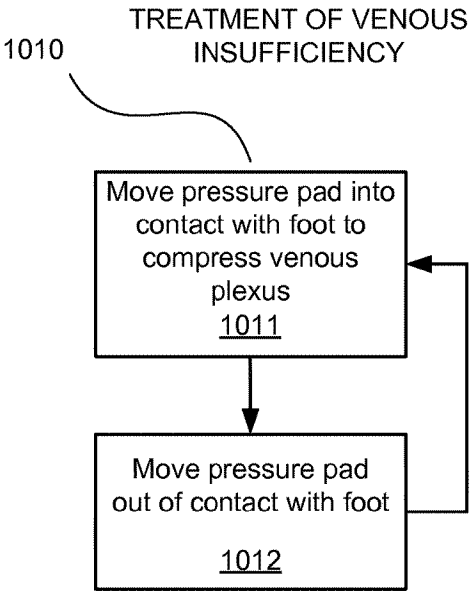

Turning now to FIG. 10, in various exemplary embodiments, insole compression system 100 may be utilized in connection with treatment of venous insufficiency. In these embodiments, activation of insole compression system 100 may be directed to increasing circulation, counteracting the effect of damaged valves in one or more veins, and/or the like. In an exemplary embodiment, insole compression system 100 is utilized to compress the venous plexus region of the foot via extension of pressure pad 112.

In an exemplary embodiment, in connection with a method 1010 for treating venous insufficiency, pressure pad 112 is extended into contact with a foot in order to force blood from the venous plexus region of the foot. Pressure pad 112 may be placed in contact with a foot (step 1011) for a desired period of time in order to force blood from the venous plexus. Pressure pad 112 may be extended with a force between about 50 Newtons and 80 Newtons in certain exemplary embodiments. Pressure pad 112 may be kept in an extended position for a time between about 1 second and about 5 seconds. Pressure pad 112 is then retracted (step 1012) in order to allow the venous plexus to at least partially refill with blood. Pressure pad 112 may then be re-extended (repeated step 1011) to force blood from the venous plexus, such as after a delay of between about 30 seconds and about 60 seconds. However, other time frames can be used, and all suitable time frames are thought to fall within the scope of the present disclosure.

In various exemplary embodiments, when utilized for treatment of venous insufficiency, insole compression system 100 may be utilized any suitable number of times in a day. In an exemplary embodiment, insole compression system 100 is used for treatment of venous insufficiency once a day. In another exemplary embodiment, insole compression system 100 is used for treatment of venous insufficiency twice a day. Moreover, insole compression system 100 may also be used more than twice a day, on alternating days, and/or on any other suitable time schedule, as desired. In certain exemplary embodiments, insole compression system 100 may be utilized on an "as-needed" basis to treat symptoms of venous insufficiency in real-time, for example responsive to patient discomfort.

In various exemplary embodiments, when utilized for treatment of venous insufficiency, insole compression system 100 may be utilized for any suitable duration. In an exemplary embodiment, insole compression system 100 is used for treatment of venous insufficiency for between about one hour and about twelve hours at a time. Moreover, insole compression system 100 may be used for any other suitable duration, as desired.

Figure 11:
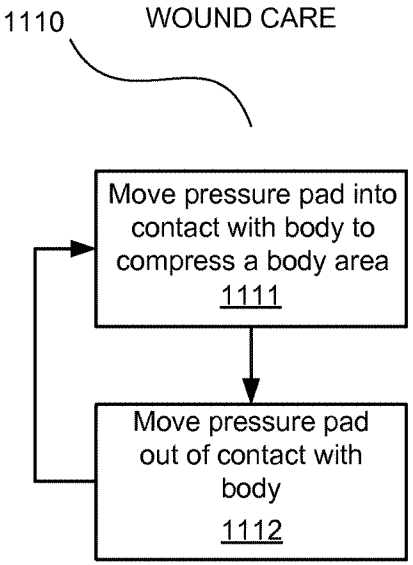

Turning now to FIG. 11, in various exemplary embodiments, insole compression system 100 may be utilized in connection with treatment of wounds. In these embodiments, activation of insole compression system 100 may be directed to increasing blood circulation and/or vascularity at and/or around a wound site. Moreover, in connection with wound care, use of insole compression system 100 may be guided and/or governed by the circulatory capacity of the body in the region of a wound. Stated another way, insole compression system 100 may be configured to increase circulation in the region of a wound without exceeding the circulatory capacity of the region of the wound. In an exemplary embodiment, insole compression system 100 is utilized to compress a portion of the body, for example the venous plexus region of the foot, via extension of pressure pad 112.

In an exemplary embodiment, in connection with a method 1110 for wound care, pressure pad 112 is extended into contact with a portion of a body, for example a foot, in order to force blood from the portion of the body and/or otherwise assist in "pumping" blood through a region of the body. Pressure pad 112 may be placed in contact with the body (step 1111) for a desired period of time in order to force blood therethrough. Pressure pad 112 may be extended with a force between about 50 Newtons and 80 Newtons in certain exemplary embodiments. Pressure pad 112 may be kept in an extended position for a time between about 1 second and about 5 seconds. Pressure pad 112 is then retracted (step 1112) in order to allow the portion of the body to at least partially refill with blood. Pressure pad 112 may then be re-extended (repeated step 1111) to force blood from the portion of the body, such as after a delay of between about 30 seconds and about 60 seconds. However, other time frames can be used, and all suitable time frames are thought to fall within the scope of the present disclosure.

In various exemplary embodiments, when utilized for wound care, insole compression system 100 may be utilized any suitable number of times in a day. In an exemplary embodiment, insole compression system 100 is used for wound care once a day. In another exemplary embodiment, insole compression system 100 is used for wound care twice a day. Moreover, insole compression system 100 may also be used more than twice a day, on alternating days, and/or on any other suitable time schedule, as desired. In certain exemplary embodiments, insole compression system 100 may be utilized on a continuous basis to provide a steadily elevated level of circulation in the region of a wound.

In various exemplary embodiments, when utilized for wound care, insole compression system 100 may be utilized for any suitable duration. In an exemplary embodiment, insole compression system 100 is used for wound care for between about one hour and about twenty-four hours at a time. Moreover, insole compression system 100 may be used for any other suitable duration, as desired.

It will be appreciated that various steps of the foregoing methods, for example extending a pressure pad into contact with a portion of the body, removing a pressure pad from contact with a portion of the body, and so forth, may be repeated as suitable in order achieve a desired outcome.

While the exemplary embodiments described herein are described in sufficient detail to enable those skilled in the art to practice principles of the present disclosure, it should be understood that other embodiments may be realized and that logical and/or functional changes may be made without departing from the spirit and scope of the present disclosure. Thus, the detailed description herein is presented for purposes of illustration and not of limitation. For example, the various operational steps, as well as the components for carrying out the operational steps, may be implemented in alternate ways depending upon the particular application or in consideration of any number of cost functions associated with the operation of the system, e.g., one or more of the steps may be deleted, modified, or combined with other steps. Further, it should be noted that while the methods and systems for compression described above are suitable for use on the foot, similar approaches may be used on the hand, calf, or other areas of the body. These and other changes or modifications are intended to be included within the scope of the present disclosure.

For the sake of brevity, conventional manufacturing approaches, materials, and other aspects of exemplary systems and methods (and components thereof) may not be described in detail herein. Furthermore, the connecting lines shown in the various figures contained herein are intended to represent functional relationships and/or physical or communicative couplings between the various elements. It should be noted that many alternative or additional functional relationships or physical connections may be present in a practical insole compression system.

While the steps outlined herein represent exemplary embodiments of principles of the present disclosure, the steps are presented for the sake of explanation only and are not intended to limit the scope of the present disclosure in any way. Benefits, other advantages, and solutions to problems have been described herein with regard to specific embodiments. However, the benefits, advantages, solutions to problems, and any element(s) that may cause any benefit, advantage, or solution to occur or become more pronounced are not to be construed as critical, required, or essential features or elements of any or all of the claims.

It should be understood that the detailed description and specific examples, indicating exemplary embodiments, are given for purposes of illustration only and not as limitations. Many changes and modifications may be made without departing from the spirit thereof, and principles of the present disclosure include all such modifications. Corresponding structures, materials, acts, and equivalents of all elements are intended to include any structure, material, or acts for performing the functions in combination with other elements. Reference to an element in the singular is not intended to mean "one and only one" unless explicitly so stated, but rather "one or more."

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, a magnetic connection, an optical connection, a communicative connection, a functional connection, and/or any other connection. Moreover, when a phrase similar to "at least one of A, B, or C" or "at least one of A, B, and C" is used in the claims or the specification, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. An insole compression system, comprising:

an insole configured for insertion into an item of footwear; and an actuator disposed in the insole, the actuator comprising:

a pressure pad pivotably coupled to an a-frame about an axle;

a first extension spring and a second extension spring coupled to the a-frame; and a torsion spring disposed about the axle.

2. The system of claim 1, further comprising a battery portion coupled to the actuator.

3. The system of claim 2, wherein the battery portion and the actuator are completely contained within the insole.

4. The system of claim 1, wherein the first extension spring, the second extension spring, and the torsion spring are configured to exert forces on the a-frame to cause extension of the pressure pad.

5. The system of claim 1, wherein the actuator exerts a force that remains between 60 Newtons and 80 Newtons over an extension range of the pressure pad of between 1 mm and 15 mm.

6. The system of claim 1, wherein the force exerted by the actuator does not vary by more than 10% over an extension range of the actuator.

7. A method of implementing athletic recovery in a person following exercise, the method comprising:

moving, via an actuator, a pressure pad a first time to bring the pressure pad into contact with a foot to compress a portion of the foot, wherein the pressure pad, the actuator, and a power source for the actuator are completely contained within an insole, the insole insertable and removable from a shoe;

moving, via the actuator, the pressure pad a second time to bring the pressure pad out of contact with the foot to allow the portion of the foot to at least partially refill with blood; and moving, via the actuator, the pressure pad a third time to bring the pressure pad into contact with the foot to force at least a portion of the blood out of the portion of the foot;

wherein the actuator comprises:

an a-frame disposed about an axle;

an extension spring coupled to the a-frame; and a torsion spring disposed about the axle.

8. A method of treating a medical condition selected from a group comprising edema, restless leg syndrome, venous insufficiency, plantar fasciitis, or a wound, the method comprising:

moving, by an insole compression system having an actuator and power source therefor completely contained in an orthotic insole, a pressure pad a first time to bring the pressure pad into contact with a portion of a human body to compress the portion of the human body;

moving, by the insole compression system, the pressure pad a second time to bring the pressure pad out of contact with the portion of a human body to allow the portion of the human body to at least partially refill with blood; and moving, by the insole compression system, the pressure pad a third time to bring the pressure pad into contact with the portion of the human body to compress the portion of the human body;

wherein the actuator comprises:

an a-frame disposed about an axle;

an extension spring coupled to the a-frame; and a torsion spring disposed about the axle.

* * * * *